US009329507B2

(12) United States Patent
Watanabe

(10) Patent No.: US 9,329,507 B2
(45) Date of Patent: May 3, 2016

(54) METHOD FOR PRODUCING ELECTROSTATIC LATENT IMAGE DEVELOPING TONER

(71) Applicant: KYOCERA DOCUMENT SOLUTIONS INC., Osaka (JP)

(72) Inventor: Yoichiro Watanabe, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 31 days.

(21) Appl. No.: 14/191,023

(22) Filed: Feb. 26, 2014

(65) Prior Publication Data

US 2014/0242509 A1 Aug. 28, 2014

(30) Foreign Application Priority Data

Feb. 27, 2013 (JP) ..... 2013-038024

(51) Int. Cl.
*G03G 9/093* (2006.01)
*G03G 9/08* (2006.01)

(52) U.S. Cl.
CPC ..... *G03G 9/0821* (2013.01); *G03G 9/09321* (2013.01); *G03G 9/09378* (2013.01); *G03G 9/09392* (2013.01)

(58) Field of Classification Search
CPC G03G 9/08755; G03G 9/0806; G03G 9/0804
See application file for complete search history.

(56) References Cited

U.S. PATENT DOCUMENTS

| | | | | |
|---|---|---|---|---|
| 2010/0196814 | A1* | 8/2010 | Joo et al. | 430/108.4 |
| 2011/0003242 | A1* | 1/2011 | Hayashi et al. | 430/108.4 |
| 2011/0033793 | A1* | 2/2011 | Chen et al. | 430/105 |
| 2011/0159427 | A1* | 6/2011 | Kang et al. | 430/108.6 |

FOREIGN PATENT DOCUMENTS

| | | | |
|---|---|---|---|
| JP | 2009-156902 | A | 7/2009 |
| JP | 2010-091790 | A | 4/2010 |
| JP | 2010-150560 | A | 7/2010 |
| JP | 2011-027775 | A | 2/2011 |

* cited by examiner

*Primary Examiner* — Hoa V Le
(74) *Attorney, Agent, or Firm* — Studebaker & Brackett PC

(57) ABSTRACT

An electrostatic latent image developing toner containing a plurality of toner particles, each including a binder resin and a release agent, is provided. The surface hardness of the toner particle, measured by a nanoindentation method, satisfies the following conditions (1) and (2): (1) The surface hardness of the toner particle attained with a displacement of 10 nm is 1 GPa or more and 3 GPa or less; and (2) the surface hardness of the toner particle attained with a displacement of 100 nm is 1 GPa or less.

2 Claims, 2 Drawing Sheets

METHOD FOR PRODUCING ELECTROSTATIC LATENT IMAGE DEVELOPING TONER

INCORPORATION BY REFERENCE

The present application claims priority under 35 U.S.C. §119 to Japanese Patent Application No. 2013-038024, filed on Feb. 27, 2013. The contents of this application are incorporated herein by reference in their entirety.

BACKGROUND

The present disclosure relates to an electrostatic latent image developing toner and a method for producing an electrostatic latent image developing toner.

In electrophotography, a high quality image is generally obtained as follows: First, the surface of a photoconductive drum is charged by using corona discharge or the like, and an electrostatic latent image is formed thereon by exposure with a laser or the like. The thus formed electrostatic latent image is developed by a toner to form a toner image. Ultimately, the thus formed toner image is transferred onto a recording medium. In general, a toner containing toner particles (toner mother particles) having an average particles size of 5 μm or more and 10 μm or less is used as the toner for forming such a toner image. In order to obtain such a toner, a mixture of a binder resin such as a thermoplastic resin and a component such as a coloring agent, a charge control agent or a release agent is subjected to a kneading process, a pulverizing process and a classifying process. This production method for a toner including the kneading of a material, the pulverizing of the kneaded product and the classification of the ground product is generally designated as a "pulverizing method". Besides, an inorganic powder of silica or titanium oxide is externally added to the toner mother particles. Thus, the resultant toner can be provided with fluidity and suitable charge performance, and a cleaning property of removing the toner from the photoconductive drum can be improved.

From the viewpoint of energy saving or downsizing of an apparatus, this type of toner is desired to have such excellent low-temperature fixability that it can be satisfactorily fixed without heating a fixing roller to the utmost. A toner having excellent low-temperature fixability, however, easily aggregates in general because most of such toners use a binder resin having a low melting point or a low glass transition point, or a release agent having a low melting point. If the toner aggregates, it is apprehended that an image defect due to adhesion of the toner onto a developing sleeve or a photoconductive drum, or fogging due to insufficient charging of the toner may be caused in forming an image.

In order to overcome this problem, a toner including toner particles with hardness, determined by using a displacement of elasticity, falling in a specific range, has been proposed. The elastic displacement is obtained on the basis of a displacement caused by applying stress and a displacement caused by removing the stress, and corresponds to a degree of plastic displacement of a toner particle.

SUMMARY

Specifically, the present disclosure provides the following:

The present disclosure relates to an electrostatic latent image developing toner containing a plurality of toner particles.

Each of the plurality of toner particles includes a binder resin and a release agent.

Each of the plurality of toner particles has surface hardness, measured by a nanoindentation method, satisfying the following conditions (1) and (2):

(1) The surface hardness of the toner particle attained with a displacement of 10 nm is 1 GPa or more and 3 GPa or less; and (2) the surface hardness of the toner particle attained with a displacement of 100 nm is 1 GPa or less.

The present disclosure further relates to a producing method for an electrostatic latent image developing toner.

The producing method includes the steps of: preparing a toner core; and forming a shell layer covering the toner core.

The step of preparing the toner core includes the sub-steps of: supplying a first unprocessed liquid containing binder resin fine particles and release agent fine particles, or a first unprocessed liquid containing fine particles including a binder resin and a release agent; supplying a second unprocessed liquid containing an aggregating agent; mixing the first unprocessed liquid and the second unprocessed liquid; and obtaining the toner core containing the binder resin and the release agent by aggregating the binder resin fine particles and the release agent fine particles or aggregating the fine particles including the binder resin and the release agent.

DETAILED DESCRIPTION

Figure 1:
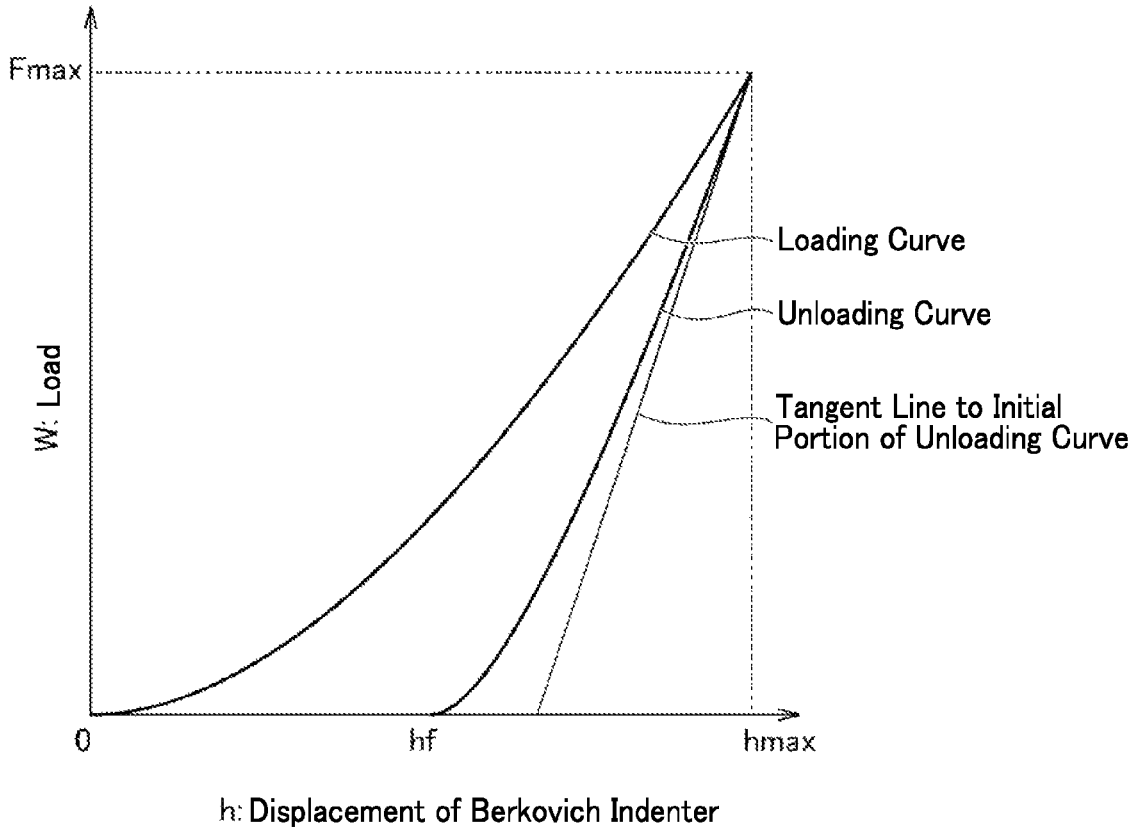
FIG. 1 is a schematic diagram of a loading curve and an unloading curve used for measurement of hardness $H_{10}$.

An embodiment of the present disclosure will now be described in detail. It is noted that the present disclosure is not limited to the following embodiment but can be practiced with appropriate modification made within the scope of the object of the present disclosure. Incidentally, description will be appropriately omitted for avoiding redundant description, which does not limit the spirit of the disclosure.

An electrostatic latent image developing toner (hereinafter, sometimes simply referred to as a toner) of the present disclosure contains a plurality of toner particles. Each of the plurality of toner particles contains a binder resin and a release agent. In the toner of the present disclosure, surface hardness of each toner particle measured by a nanoindentation method satisfies the following conditions (1) and (2):

(1) The surface hardness of the toner particle attained with a displacement of 10 nm (hereinafter sometimes referred to as the hardness $H_{10}$) is 1 GPa or more and 3 GPa or less; and (2) the surface hardness of the toner particle attained with a displacement of 100 nm (hereinafter sometimes referred to as the hardness $H_{100}$) is 1 GPa or less.

Now, the nanoindentation method and the toner of the present disclosure will be described.

<<Nanoindentation Method>>

The hardness $H_{10}$ refers to the hardness of the surface of a toner particle. When the hardness $H_{10}$ is specified to fall in a range of 1 GPa or more to 3 GPa or less, a toner that has excellent storage stability and can suppress, in an image formed by using the toner, occurrence of fogging and image quality degradation due to adhesion of a toner component onto a developing sleeve or a photoconductive drum can be easily obtained. The hardness $H_{100}$ refers to the hardness of the inside of a toner particle. When the hardness $H_{100}$ is specified to fall in a range of 1 GPa or less, a toner that has excellent low-temperature fixability and can suppress occurrence of an offset at a high temperature can be easily obtained.

The hardness $H_{10}$ can be adjusted by adjusting the glass transition point of a material forming a surface layer of a toner particle. Specifically, the value of the hardness $H_{10}$ can be increased by increasing the glass transition point of the material forming the surface layer of the toner particle.

If the toner particle does not have a coating layer (shell layer) on the surface thereof as in a toner particle not having a core-shell structure (i.e., a structure in which the surface of a toner core is covered with a shell layer), the hardness $H_{10}$ can be adjusted by adjusting the glass transition point of a binder resin. For adjusting the glass transition point of the binder resin, various methods can be employed depending upon the type of the resin, and for example, a method in which the molecular weight of the resin is controlled, or a method in which a crosslinked structure is introduced into the resin may be employed. The glass transition point of the resin is liable to become higher when the molecular weight of the resin is increased or the degree of crosslinkage of the resin is increased. For introducing a crosslinked structure into the resin, for example, a method in which a polyfunctional crosslinkable monomer is used in synthesis of the resin or a method in which a known crosslinking agent is mixed with the resin may be employed.

If the toner particle has a core-shell structure, the hardness $H_{10}$ can be adjusted by adjusting the glass transition point of a material forming the shell layer by a method similar to the method for adjusting the glass transition point of the binder resin. If the toner particle has a core-shell structure, the hardness $H_{10}$ is affected also by the glass transition point of the binder resin contained in the toner core. Therefore, also in the toner particle having a core-shell structure, the hardness $H_{10}$ can be increased by increasing the glass transition point of the binder resin.

The hardness $H_{100}$ is mainly affected by the characteristics of the binder resin contained in the toner particle. Therefore, the hardness $H_{100}$ can be adjusted by adjusting the glass transition point of the binder resin. Specifically, the value of the hardness $H_{100}$ can be increased by increasing the glass transition point of the binder resin. For adjusting the glass transition point of the binder resin, the same method as the method for adjusting the glass transition point of the binder resin for adjusting the hardness $H_{10}$ can be employed.

If the hardness $H_{10}$ is too low, the surface layer of the toner particle is excessively soft. Therefore, while the toner is being stored at a high temperature, the toner particles having a soft surface layer easily aggregate with each other. Therefore, if the hardness $H_{10}$ is too low, a toner having excellent storage stability is difficult to obtain. Besides, in continuously forming images, mechanical stress is applied to the toner. Therefore, if the surface layer of the toner particle is excessively soft, there arises a problem of, for example, elimination of an external additive or a release agent from the surface of the toner particle, embedding of the external additive in a surface portion of the toner particle, or aggregation of toner particles in a developing unit, resulting in degrading the fluidity of the toner particles in the developing unit. If the fluidity of the toner particles is degraded, the toner particles are difficult to be charged to a desired charge amount, and hence, an image defect such as fogging is caused in an image formed by the toner. Alternatively, if the release agent is eliminated from the surface of the toner particle, the toner particle or a component contained in the toner is adhered onto the developing sleeve or the photoconductive drum, resulting in easily degrading the quality of an image formed by the toner.

On the other hand, if the hardness $H_{10}$ is too high, the surface layer of the toner particle is excessively hard, and hence, it is difficult to excellently fix a toner image onto a recording medium at a low temperature.

If the hardness $H_{100}$ is too high, since the inside of the toner particle is excessively hard, it is difficult to excellently fix a toner image onto a recording medium at a low temperature. Besides, if a toner image is fixed onto a recording medium at a high temperature, a toner component (such as the release agent) is difficult to elute from the inside of the toner particle, and hence, an offset is easily caused at a high temperature.

The measurement of the hardness ($H_{10}$ and $H_{100}$) of the surface of the toner particle by the nanoindentation method is performed by using a nanoindentation hardness tester (such as Nanoindenter (ENT-2100) manufactured by Elionix Inc.). Procedures for measuring the hardness $H_{10}$ and the hardness $H_{100}$ by the nanoindentation method will now be described.

<Measurement Method for Hardness $H_{10}$>

(Determination of Load $W_{10}$ with Indenter Displacement of 10 nm)

(1-1)

With a load applied to a toner particle to attain a maximum load of 100 μN, a Berkovich indenter in a conical shape with a tip angle of 115° is thrust into the toner particle. At this point, a displacement of the Berkovich indenter caused in changing the load applied to the toner particle from 0 μN to 100 μN is recorded.

(1-2)

The thus obtained data about the load and the displacement of the Berkovich indenter is plotted on a plane (i.e., a plane having an abscissa indicating the displacement (nm) of the Berkovich indenter and an ordinate indicating the load (μN)), so as to obtain an indenter displacement-load curve.

(1-3)

From the indenter displacement-load curve, a load $W_{10}$ (μN) corresponding to a displacement of the Berkovich indenter of 10 nm is read.

(1-4)

The load $W_{10}$ is measured in accordance with the procedures (1-1) to (1-3) in one position per toner particle. The measurement of the load $W_{10}$ is performed for 10 toner particles. An average of the loads $W_{10}$ measured in the 10 positions is defined as a value of the load $W_{10}$.

(Measurement of Hardness $H_{10}$)

(2-1)

With a load applied to a toner particle to attain a maximum load of the load $W_{10}$ (μN), a Berkovich indenter is thrust into the toner particle. At this point, a displacement of the Berkovich indenter caused in changing the load applied to the toner particle from 0 μN to the load $W_{10}$ is recorded.

(2-2)

After the load applied to the toner particle reaches the load $W_{10}$, the load applied to the toner particle is removed. At this point, a displacement of the Berkovich indenter caused in changing the load applied to the toner particle from the load $W_{10}$ to 0 μN is recorded.

(2-3)

The thus obtained data about the load and the displacement of the Berkovich indenter is plotted on a plane (i.e., a plane having an abscissa indicating the displacement (nm) of the Berkovich indenter and an ordinate indicating the load (μN)). In this manner, a loading curve corresponding to an indenter displacement-load curve obtained in loading and an unloading curve corresponding to an indenter displacement-load curve obtained in unloading are obtained.

The loading curve and unloading curve thus obtained are schematically illustrated in FIG. 1.

(2-4)

The following formula (1) is approximated to the unloading curve by using a least squares method, so as to determine values of A and m:

$$W=A(h-hf)^m \quad \text{Formula (1)}$$

In formula (1), A and m represent constants obtained by approximating formula (1) to the unloading curve by using the least squares method; W represents a load applied to the toner; h represents a displacement of the Berkovich indenter; and hf represents a displacement (remaining depth) of the Berkovich indenter at an intersection point between the unloading curve and the abscissa indicating the displacement of the Berkovich indenter.

(2-5)

In accordance with the following formula (2), S (a stiffness value) is calculated on the basis of the inclination of a tangent line to an initial portion of the unloading curve:

$$S=dW/dh=mA(h\max-hf)^{m-1} \quad \text{Formula (2)}$$

In formula (2), hmax represents a displacement of the Berkovich indenter attained with the maximum load $W_{10}$.

(2-6)

In accordance with the following formula (3), hc (a contact depth) is obtained:

$$hc=h\max-\in W_{10}/S \quad \text{Formula (3)}$$

In Formula (3), hc represents a contact depth; and $\in$ represents a constant pertaining to the shape of the indenter, which is 0.75 in the Berkovich indenter.

(2-7)

In accordance with the following formula (4), Ac (a projected contact area) is obtained:

$$Ac=24.5hc^2+f(hc) \quad \text{Formula (4)}$$

In formula (4), f(hc) represents a correction term obtained on the basis of the curvature of the indenter. As for the Berkovich indenter attached to the nanoindenter (ENT-2100) and having a tip angle of 115°, the correction term f(hc) can be obtained by using the Oliver-Pharr method.

(2-8)

In accordance with the following formula (5), the hardness $H_{10}$ is obtained:

$$H_{10}=F\max/Ac \quad \text{Formula (5)}$$

In formula (5), Fmax represents the maximum load, which is the load $W_{10}$ in the measurement of the hardness $H_{10}$.

(2-9)

The hardness $H_{10}$ is measured in accordance with the procedures (2-1) to (2-8) in five positions per toner particle. The measurement of the hardness $H_{10}$ is performed for 100 toner particles. An average of the hardnesses $H_{10}$ obtained in 500 positions in total is defined as the value of the hardness $H_{10}$ of the toner particle.

<Measurement Method for Hardness $H_{100}$>

(Determination of Load $W_{100}$ with Indenter Displacement of 100 nm)

In the same manner as in the measurement of the hardness $H_{10}$, except that a load corresponding to a displacement of the Berkovich indenter of 100 nm is read in the procedure (1-3), a load $W_{100}$ (μN) corresponding to the displacement of the Berkovich indenter of 100 nm is obtained. Subsequently, in the same manner as in the measurement of the hardness $H_{10}$, except that the maximum load used in obtaining a loading curve and an unloading curve is the load $W_{100}$ instead of the load $W_{10}$, the hardness $H_{100}$ is obtained.

<<Toner>>

The toner of the present disclosure contains a plurality of toner particles. Each of the plurality of toner particles contains a binder resin and a release agent. The toner particle contained in the toner of the present disclosure may contain another component such as a coloring agent, a charge control agent or a magnetic powder if necessary. The structure of the toner particle is not especially limited as long as the toner particle has the aforementioned hardness $H_{10}$ and hardness $H_{100}$ respectively falling in the prescribed ranges. The toner of the present disclosure preferably contains a toner particle having a core-shell structure because excellent storage stability can be thus attained. Such a toner particle includes a toner core containing a binder resin and a release agent; and a shell layer covering the toner core. The shell layer is preferably made of a resin having a higher glass transition point Tg than the binder resin contained in the toner core. Components used for preparing the toner (such as a binder resin, a release agent, a coloring agent, a charge control agent and a magnetic powder) can be common between a core-shell structure toner particle and a non-core-shell structure toner particle having no shell layer on the surface thereof.

The toner of the present disclosure may contain, as optionally demanded, a toner particle having an external additive adhered to the surface thereof. The toner of the present disclosure may be mixed with a desired carrier to be used as a two-component developer.

A method for producing the toner particles is not especially limited as long as the object of the present disclosure is not impaired. If a toner particle contained in the toner has a non-core-shell structure having no shell layer on the surface thereof, the toner particle may be produced by employing a "pulverizing method" or an "aggregation method" described below.

The pulverizing method is performed roughly as follows: First, a component such as a coloring agent or a charge control agent is added to a binder resin and a release agent if necessary. Thereafter, the resultant is mixed by using a mixer to give a mixture. The thus obtained mixture is melt kneaded by using a melt-kneader (such as a single screw extruder or a twin screw extruder) to give a melt kneaded product. The thus obtained melt kneaded product is roughly pulverized and then finely pulverized into a desired particle size. Thereafter, the resulting finely pulverized product is classified to obtain toner particles.

The aggregation method is performed roughly as follows: First, an aggregating agent is added to a fine particle dispersion containing fine particles of components of toner particles (such as binder resin fine particles and release agent fine particles). Thereafter, aggregation is allowed to proceed until aggregated particles attain a desired particle size, and thus, fine particle aggregates are obtained. Subsequently, the components contained in the fine particle aggregates are coalesced by heating in an aqueous medium if necessary, so as to obtain toner particles.

Now, a toner containing a core-shell structure toner particle, which is preferable as the toner of the present disclosure, will be described. Specifically, a toner core and a shell layer for covering the toner core will be described. Furthermore, with respect to a core-shell structure toner particle, an external additive and a carrier, which is used in using the toner of the present disclosure as a two-component developer, will be described.

[Toner Core]

A toner core contains a binder resin and a release agent. The toner core may contain another component such as a coloring agent, a charge control agent or a magnetic powder if necessary. With respect to the toner core, essential components (i.e., a binder resin and a release agent), an optional component (i.e., a coloring agent, a charge control agent or a magnetic powder), and a method for producing the toner core will now be successively described.

[Binder Resin]

The binder resin contained in the toner core of the toner particles included in the toner of the present disclosure is not especially limited as long as the hardness $H_{10}$ and the hardness $H_{100}$ of the resultant toner particle have values respectively falling in the above-described prescribed ranges.

Specific examples of the binder resin include thermoplastic resins (such as styrene resins, acrylic resins, styrene acrylic resins, polyethylene resins, polypropylene resins, vinyl chloride resins, polyester resins, polyamide resins, polyurethane resins, polyvinyl alcohol resins, vinyl ether resins, N-vinyl resins, and styrene-butadiene resins). Among these resins, from the viewpoint of dispersibility of a coloring agent in the toner, chargeability of the toner and the fixability on paper, the styrene acrylic resins and the polyester resins are preferably used, and the polyester resins are more preferably used. The styrene acrylic resins and the polyester resins used in the present embodiment will now be described.

A styrene acrylic resin is a copolymer of a styrene monomer and an acrylic monomer. Specific examples of the styrene monomer include styrene, α-methyl styrene, vinyl toluene, α-chloro styrene, o-chloro styrene, m-chloro styrene, p-chloro styrene and p-ethyl styrene. Specific examples of the acrylic monomer include alkyl ester (meth)acrylates (such as methyl acrylate, ethyl acrylate, n-propyl acrylate, iso-propyl acrylate, n-butyl acrylate, iso-butyl acrylate, 2-ethyl hexyl acrylate, methyl methacrylate, ethyl methacrylate, n-butyl methacrylate, and iso-butyl methacrylate).

If a polyester resin is used as the binder resin, a toner that can be satisfactorily fixed over a wide temperature range and shows an excellent color developing property can be easily prepared. The polyester resin can be a resin obtained by condensation polymerization or co-condensation polymerization of a bivalent, trivalent or higher-valent alcohol component and a bivalent, trivalent or higher-valent carboxylic acid component. Examples of components used in synthesizing a polyester resin include the following alcohol components and carboxylic acid components.

Specific examples of the bivalent, trivalent or higher-valent alcohol component include diols (such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol), bisphenols (such as bisphenol A, hydrogenated bisphenol A, polyoxyethylene bisphenol A, and polyoxypropylene bisphenol A), and trivalent or higher-valent alcohols (such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene).

Specific examples of the bivalent, trivalent or higher-valent carboxylic acid component include bivalent carboxylic acids (such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and alkyl- or alkenyl-succinic acid (such as n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, or isododecenyl succinic acid)), and trivalent or higher-valent carboxylic acids (such as 1,2,4-benzenetricarboxylic acid (trimellitic acid), 1,2,5-benzenetricarboxylic acid, 2,5,7-naphthalenetricarboxylic acid, 1,2,4-naphthalenetricarboxyic acid, 1,2,4-butanetricarboxylic acid, 1,2,5-hexanetricarboxylic acid, 1,3-dicarboxyl-2-methyl-2-metheylenecarboxy propane, 1,2,4-cyclohexanetricarboxylic acid, tetra(methylenecarboxyl)methane, 1,2,7,8-octanetetracarboxylic acid, pyromellitic acid and Empol trimer acid). The bivalent, trivalent or higher-valent carboxylic acid component may be used in the form of an ester-forming derivative, such as an acid halide, an acid anhydride or a lower alkyl ester. Here, a "lower alkyl" means an alkyl group having 1 to 6 carbon atoms.

If a polyester resin is used as the binder resin, the acid value of the polyester resin is preferably 10 mgKOH/g or more and 40 mgKOH/g or less. The acid value of the polyester resin can be adjusted by adjusting balance between a hydroxyl group of the alcohol component and a carboxyl group of the carboxylic acid component used in the synthesis of the polyester resin.

As the binder resin, not only a thermoplastic resin may be singly used but also a thermoplastic resin containing a crosslinking agent or a thermosetting resin may be used. By partly introducing a crosslinked structure into the binder resin, the storage stability, the shape retention or the durability of the resultant toner can be improved without degrading the fixability of the toner.

As the thermosetting resin used together with the thermoplastic resin, an epoxy resin or a cyanate resin is preferably used. Specific examples of a suitable thermosetting resin include bisphenol A type epoxy resins, hydrogenated bisphenol A type epoxy resins, novolac type epoxy resins, polyalkylene ether type epoxy resins, cyclic aliphatic epoxy resins and cyanate resins. Two or more of these thermosetting resins may be used in combination.

The glass transition point ($Tg_1$) of the binder resin is preferably 35° C. or more and 67° C. or less, and more preferably 37° C. or more and 50° C. or less. If the glass transition point of the binder resin is too low, toner particles may be fused with each other in a developing unit of an image forming apparatus, or toner particles may be partially fused with each other, due to degradation of the storage stability of the toner, during transportation or storage in a warehouse of a toner container. Besides, if the glass transition point of the binder resin is too low, the binder resin is lowered in the strength, and hence the toner particles are easily adhered to a latent image bearing section. Alternatively, if the glass transition point of the binder resin is too high, there is a tendency that the toner is difficult to be satisfactorily fixed at a low temperature.

The melting point ($Tm_1$) of the binder resin is preferably 65° C. or more and 120° C. or less, and more preferably 70° C. or more and 100° C. or less. If the melting point of the binder resin is too high, it becomes difficult to satisfactorily fix the toner at a low temperature. If the melting point of the binder resin is too low, toner particles are aggregated with each other when stored at a high temperature, resulting in degrading the high-temperature preservability of the toner. The melting point of the binder resin can be measured by using a differential scanning calorimeter (DSC).

The number average molecular weight ($Mn_1$) of the binder resin is preferably 1,000 or more and 10,000 or less, and more preferably 2,000 or more and 5,000 or less. The mass average molecular weight ($Mw_1$) of the binder resin is preferably 2,000 or more and 30,000 or less, and more preferably 3,000 or more and 15,000 or less. Besides, a molecular weight distribution ($Mw_1/Mn_1$) expressed as a ratio between the number average molecular weight ($Mn_1$) and the mass average molecular weight ($Mw_1$) is preferably 1.5 or more and 3.5 or less. When the molecular weight distribution of the binder resin is specified to fall in this range, a toner excellent in the low-temperature fixability can be easily obtained. The number average molecular weight ($Mn_1$) and the mass average molecular weight ($Mw_1$) of the binder resin can be measured by gel permeation chromatography.

[Release Agent]

The toner core contains a release agent for purpose of improving the fixability or the offset resistance of the toner. The type of release agent is not especially limited as long as it is conventionally used as a release agent for a toner.

Preferable examples of the release agent include aliphatic hydrocarbon waxes (such as low molecular weight polyethylene, low molecular weight polypropylene, polyolefin copolymers, polyolefin wax, microcrystalline wax, paraffin wax and Fischer-Tropsch wax), oxides of the aliphatic hydrocarbon waxes (such as polyethylene oxide wax and a block copolymer of polyethylene oxide wax), vegetable waxes (such as candelilla wax, carnauba wax, haze wax, jojoba wax and rice wax), animal waxes (such as beeswax, lanolin and spermaceti wax), mineral waxes (such as ozokerite, ceresin and petrolatum), waxes containing a fatty acid ester as a principal component (such as montanic acid ester wax and castor wax), and waxes obtained by deoxidizing part or whole of fatty acid ester (such as deoxidized carnauba wax).

The amount of the release agent to be used is preferably 8 parts by mass or more and 20 parts by mass or less, and more preferably 10 parts by mass or more and 15 parts by mass or less based on 100 parts by mass of the binder resin. If the amount of the release agent is excessively small, a desired effect to suppress occurrence of an offset or image smearing in a formed image cannot be attained. On the other hand, if the amount of the release agent is excessively large, toner particles are fused with each other to degrade the storage stability of the toner.

[Coloring Agent]

The toner core may contain a coloring agent if necessary. As the coloring agent, any of known pigments or dyes can be used in accordance with the color of toner particles. Specific examples of the coloring agent suitably added to the toner core include the following:

An example of a black coloring agent includes carbon black. Specific examples of the carbon black include Raven 1060, 1080, 1170, 1200, 1250, 1255, 1500, 2000, 3500, 5250, 5750, 7000, 5000 ULTRAII and 1190 ULTRAII manufactured by Columbian Carbon Co.; Black Pearls L, Mogul-L, Regal 400R, 660R, 330R, Monarch 800, 880, 900, 1000, 1300 and 1400 manufactured by Cabot Corporation; Color Black FW1, FW2, FW200, 18, S160, S170, Special Black 4, 4A, 6, Printex 35, U, 140U, V and 140V manufactured by Degussa Ag; and Nos. 25, 33, 40, 47, 52, 900, 2300, MCF-88, MA600, 7, 8 and 100 manufactured by Mitsubishi Chemical Corporation. Alternatively, a coloring agent whose color is adjusted to black by using coloring agents such as a yellow coloring agent, a magenta coloring agent and a cyan coloring agent described later may be used as the black coloring agent. Examples of a coloring agent for a color toner include a yellow coloring agent, a magenta coloring agent and a cyan coloring agent.

Examples of the yellow coloring agent include condensed azo compounds, isoindolinone compounds, anthraquinone compounds, azo metal complexes, methine compounds and allylamide compounds. Specific examples include C.I Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 191 and 194.

Examples of the magenta coloring agent include condensed azo compounds, diketopyrrolopyrrole compounds, anthraquinone compounds, quinacridone compounds, basic dye lake compounds, naphthol compounds, benzimidazolone compounds, thioindigo compounds and perylene compounds. Specific examples include C.I Pigment Red 2, 3, 5, 6, 7, 19, 23, 48:2, 48:3, 48:4, 57:1 81:1, 122, 144, 146, 150, 166, 169, 177, 184, 185, 202, 206, 220, 221 and 254.

Examples of the cyan coloring agent include copper phthalocyanine compounds, copper phthalocyanine derivatives, anthraquinone compounds and basic dye lake compounds. Specific examples include C.I. Pigment Blue 1, 7, 15, 15:1, 15:2, 15:3, 15:4, 60, 62 and 66.

One of these coloring agents can be singly used, or any of these can be used in the form of a mixture. The amount of the coloring agent to be used is not especially limited as long as the object of the present disclosure is not impaired. Specifically, the amount of the coloring agent to be used is preferably 3 parts by mass or more and 15 parts by mass or less based on 100 parts by mass of the binder resin.

[Charge Control Agent]

The toner core may contain a charge control agent if necessary. The charge control agent is used for purpose of improving the stability in charge level of a toner or the charge rising property of the toner, so as to obtain a toner excellent in the durability or the stability. The charge rising property is an index whether or not the toner can be charged to prescribed charge level in a short period of time. If development is performed with the toner positively charged, a positively chargeable charge control agent is used. If the development is performed with the toner negatively charged, a negatively chargeable charge control agent is used.

The type of charge control agent can be appropriately selected from charge control agents conventionally used for a toner. Specific examples of the positively chargeable charge control agent include azine compounds (such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline and quinoxaline), direct dyes made from an azine compound (such as azine fast red FC, azine fast red 12BK, azine violet BO, azine brown 3G, azine light brown GR, azine dark green BH/C, azine deep black EW, and azine deep black 3RL), nigrosine compounds (such as nigrosine, nigrosine salts and nigrosine derivatives), acidic dyes made from a nigrosine compound (such as nigrosine BK, nigrosine NB and nigrosine Z), metal salts of naphthenic acid or higher fatty acid, alkoxylated amine, alkyl amide, and quaternary ammonium salts (such as benzylmethylhexyldecyl ammonium and decyl trimethyl ammonium chloride). Among these positively chargeable charge control agents, nigrosine compounds are particularly preferably used because a rapider charge rising property can be attained by them. Two or more of these positively chargeable charge control agents may be used in combination.

A resin having, as a functional group, a quaternary ammonium salt, a carboxylate salt or a carboxyl group can be used as the positively chargeable charge control agent. Specific examples of such a resin include styrene resins having a quaternary ammonium salt, acrylic resins having a quaternary ammonium salt, styrene acrylic resins having a quaternary ammonium salt, polyester resins having a quaternary ammonium salt, styrene resins having a carboxylate salt, acrylic resins having a carboxylate salt, styrene acrylic resins having a carboxylate salt, polyester resins having a carboxylate, styrene resins having a carboxyl group, acrylic resins having a carboxyl group, styrene acrylic resins having a carboxyl group, and polyester resins having a carboxyl group. The molecular weight of such a resin is not especially limited as long as the object of the present disclosure is not impaired, and the resin may be an oligomer or a polymer.

Specific examples of the negatively chargeable charge control agent include organic metal complexes and chelate compounds. As the organic metal complexes and the chelate compounds, acetylacetone metal complexes (such as aluminum acetyl acetonate and iron (II) acetyl acetonate), salicylic acid metal complexes and salicylic acid metal salts (such as chromium 3,5-di-tert-butylsalicylate) are preferably used, and the salicylic acid metal complexes and salicylic acid metal salts are more preferably used. Two or more of these negatively chargeable charge control agents may be used in combination.

The typical amount of the positively chargeable or negatively chargeable charge control agent to be used is preferably 1.5 parts by mass or more and 15 parts by mass or less, more preferably 2.0 parts by mass or more and 8.0 parts by mass or less, and particularly preferably 3.0 parts by mass or more and 7.0 parts by mass or less based on 100 parts by mass of the whole amount of the toner. If the amount of the charge control agent is excessively small, it is difficult to stably charge the toner to a desired polarity, and therefore, an image density of a formed image does not reach a desired value or it is difficult to retain the image density for a long period of time. Besides, in such a case, the charge control agent is difficult to be homogeneously dispersed in the toner, and therefore, fogging is easily caused in a formed image or the latent image carrying section is easily stained due to adhesion of toner particle components. If the amount of the charge control agent is excessively large, an image defect is easily caused in a formed image due to insufficient charging occurring at a high temperature and a high humidity due to degradation in environmental resistance, or the latent image bearing section is easily stained due to the adhesion of toner components.

[Magnetic Powder]

The toner core of the toner particle contained in the toner of the present disclosure may contain a magnetic powder if necessary. The type of magnetic powder is not especially limited as long as the object of the present disclosure is not impaired. Examples of a suitable material of the magnetic powder include iron (such as ferrite and magnetite), ferromagnetic metals (such as cobalt and nickel), alloys containing iron and/or a ferromagnetic metal, compounds containing iron and/or a ferromagnetic metal, ferromagnetic alloys having been ferromagnetized by heating or the like, and chromium dioxide.

The particle size of the magnetic powder is preferably 0.1 μm or more and 1.0 μm or less, and more preferably 0.1 μm or more and 0.5 μm or less. If a magnetic powder having a particle size falling in this range is used, the magnetic powder can be easily homogeneously dispersed in the binder resin.

For purpose of improving the dispersibility of the magnetic powder in the toner core, the magnetic powder may be subjected to a surface treatment with a coupling agent (such as a titanium coupling agent or a silane coupling agent) before use.

The amount of the magnetic powder to be used is, if the toner is used as a one-component developer, preferably 35 parts by mass or more and 60 parts by mass or less, and more preferably 40 parts by mass or more and 60 parts by mass or less based on 100 parts by mass of the whole amount of the toner. If the amount of the magnetic powder is excessively large, it may become difficult to retain an image density at a desired value for a long period of time, or the fixability of the toner may be extremely lowered. If the amount of the magnetic powder is excessively small, fogging may be easily caused in a formed image, or it may become difficult to form images of a desired image density for a long period of time. Alternatively, if the toner is used as a two-component developer, the amount of the magnetic powder to be used is preferably 20 parts by mass or less and more preferably 15 parts by mass or less based on 100 parts by mass of the whole amount of the toner.

[Method for Producing Toner Core]

A method for producing the toner core is not especially limited as long as a toner containing a toner particle having the aforementioned hardness $H_{10}$ and $H_{100}$ respectively falling in the prescribed ranges can be produced. As a suitable method for producing the toner core, the above-described pulverizing method or aggregation method can be employed.

Among various production methods for the toner core, the aggregation method is preferred because toner cores in a uniform shape can be easily produced by this method, and in particular, an aggregation method using a microreactor is preferably employed.

The microreactor used in the aggregation method includes a fixed disk A, a rotary disk B, a first unprocessed liquid supply section, and one or more second unprocessed liquid supply sections. The fixed disk A and the rotary disk B are circular disks, and are arranged to have a space between the circular surfaces of these two disks in producing the toner core. The first unprocessed liquid supply section supplies a first unprocessed liquid (liquid A) into the space from an end of the space. The second unprocessed liquid supply section supplies a second unprocessed liquid (liquid B) into the space from an upper surface side of the fixed disk. The second unprocessed liquid supply section is formed to penetrate through the upper surface and the lower surface of the fixed disk on one side of the circular center of the fixed disk opposite to the first unprocessed liquid supply section. The second unprocessed liquid supply section may be provided in two or more positions.

The first unprocessed liquid (liquid A) is a fine particle dispersion containing fine particles including the binder resin (binder resin fine particles) and fine particles including the release agent (release agent fine particles), or a fine particle dispersion containing fine particles including the binder resin and the release agent. The second unprocessed liquid (liquid B) is a liquid containing an aggregating agent for aggregating the fine particles contained in the first unprocessed liquid.

When the liquid A and the liquid B are mixed and the resin fine particles are thus aggregated by using the microreactor, a toner core is obtained as a product X. Now, the microreactor and the method for producing the toner core by using the microreactor will be described with reference to FIG. 2.

(Microreactor)

Figure 2:
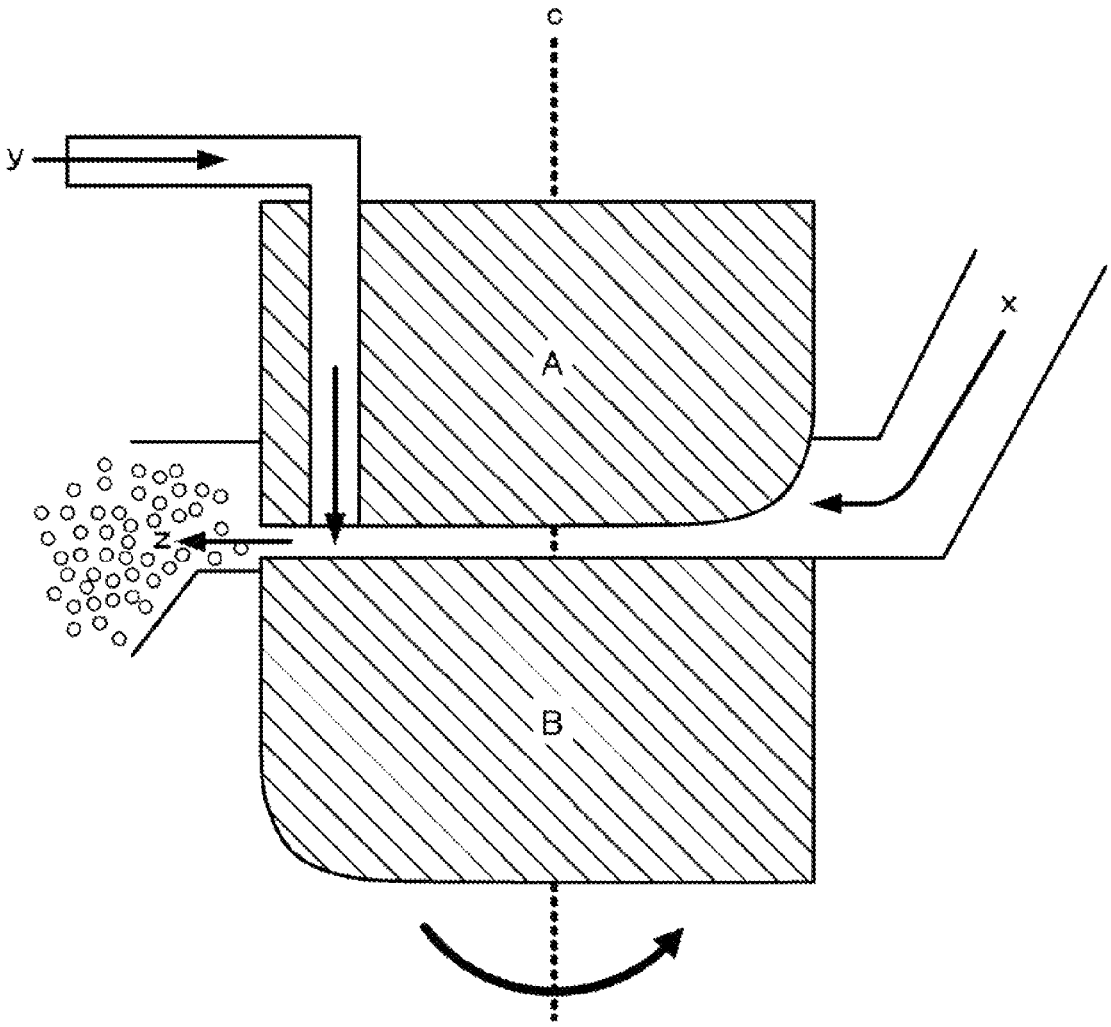
FIG. 2 is a cross-sectional view of a microreactor.

FIG. 2 is a cross-sectional view of a microreactor used in the production of the toner core. As illustrated in FIG. 2, the microreactor includes circular disks, that is, a fixed disk A and a rotary disk B. The fixed disk A and the rotary disk B are arranged to have a space therebetween in which a thin layer can be formed.

In the microreactor illustrated in FIG. 2, a liquid A (that is, a fine particle dispersion containing fine particles including components of the toner core) is supplied from a first unprocessed liquid supply section x, and a liquid B (that is, a liquid containing an aggregating agent) is supplied from a second unprocessed liquid supply section y. By supplying the liquid A and the liquid B, aggregation of the fine particles including the components of the toner core is allowed to proceed in the space formed between the fixed disk A and the rotary disk B, resulting in forming the toner core. The thus formed toner cores are ejected in the form of a toner core dispersion from a liquid exit port z.

The supply amount of the liquid A may be varied depending upon the shape of the microreactor, and typically, is preferably 100 ml/min or more and 1000 ml/min or less. The supply amount of the liquid B may be varied depending upon the supply amount of the liquid A, and typically, is preferably 1 ml/min or more and 500 ml/min or less. Besides, with respect to the temperatures of the liquid A and the liquid B to be supplied, the temperature of a mixture of the liquid A and the liquid B is preferably adjusted, in the space formed in the microreactor, to be equal to or higher than the glass transition point ($Tg_1$) of the binder resin contained as a component of the toner core.

The fixed disk A of the microreactor illustrated in FIG. 2 has a floating structure movable in a direction parallel to its rotation axis c. The height of the space formed between the fixed disk A and the rotary disk B is adjusted by controlling a pressure, which is caused by the liquid A flowing in from the first unprocessed liquid supply section x and works in a direction to push up the fixed disk A (i.e., in the upward direction in FIG. 2), the weight of the fixed disk A, and a pressure applied in a direction to push down the fixed disk A (i.e., in the downward direction in FIG. 2). In the production of the toner core, the height of the space formed between the fixed disk A and the rotary disk B can be adjusted by adjusting one or more of the flow rate of the liquid A, the mass of the fixed disk A and the back pressure applied from above the fixed disk A. The back pressure applied to the fixed disk A is, for example, a back pressure caused by using a gas. The back pressure applied in the production of the toner core is preferably 0.5 MPa (G) or less.

The materials of the fixed disk A and the rotary disk B are not especially limited as long as the materials are difficult to be corroded by the liquid A or the liquid B and have sufficient strength. As the materials of the fixed disk A and the rotary disk B, a hard material that may be mirror polished is preferably used, and specific examples of such a material include silicon carbide, tungsten carbide and boron ceramics. As the materials of the fixed disk A and the rotary disk B, a material having a surface coated with diamond-like carbon may be used.

The height of the space formed between the fixed disk A and the rotary disk B is adjusted in accordance with the particle size of the toner core to be produced. The height of the space is preferably 1 μm or more and 50 μm or less.

The fixed disk A and the rotary disk B preferably have the same diameter. The diameters of the fixed disk A and the rotary disk B are not especially limited but are preferably 100 mm or more and 300 mm or less.

The rotary disk B is rotated around the rotation axis c passing through the centers of the fixed disk A and the rotary disk B. In preparing the toner core, the rotational speed of the rotary disk B is preferably 200 rpm or more and 3,500 rpm or less, and more preferably 500 rpm or more and 2,000 rpm or less. If the rotational speed of the rotary disk B is out of this preferable range, it is difficult to obtain toner cores having a desired particle size and having a sharp particle size distribution.

As a method for attaining a sharp particle size distribution of the toner cores to be produced, for example, the back pressure applied from above the fixed disk A is increased, the rotational speed of the rotary disk B is increased, or the supply amount of the liquid B is increased.

The number of the second unprocessed liquid supply section y provided in the fixed disk A may be one or plural. If the second unprocessed liquid supply section y is provided in a plural number, the liquid B containing the aggregating agent to be supplied from these second unprocessed liquid supply sections may be a single type or plural types. The shape of the second unprocessed liquid supply section y is appropriately designed in consideration of the supply amount of the liquid B.

When the above-described microreactor is used, toner cores having a sharp particle size distribution and a desired particle size can be produced in a short period of time. An example of the microreactor having the aforementioned structure includes a forced thin film microreactor (ULREA SS-11 (manufactured by M Technique Co., Ltd.)). Now, the method for producing the toner core by using the microreactor will be described.

(Method for Producing Toner Core by Using Microreactor)

First, a liquid A (a fine particle dispersion containing fine particles including components of the toner core) and a liquid B (a solution containing an aggregating agent) used in the production of the toner core will be described.

The liquid A is a fine particle dispersion containing binder resin fine particles and release agent fine particles, or a fine particle dispersion containing fine particles including a binder resin and a release agent. If the liquid A is a fine particle dispersion containing binder resin fine particles and release agent fine particles, a precedently prepared mixture of a dispersion containing binder resin fine particles and a dispersion containing release agent fine particles may be supplied, as the liquid A, to a line connected to the first unprocessed liquid supply section x. Alternatively, a dispersion containing binder resin fine particles and a dispersion containing release agent fine particles may be individually supplied to a line connected to the first unprocessed liquid supply section x so as to mix the binder resin fine particles and the release agent fine particles in the line to be supplied as the liquid A. Incidentally, the liquid B is a liquid containing an aggregating agent for aggregating the fine particles contained in the liquid A.

Liquid A

The liquid A is a dispersion containing fine particles. The fine particles contain components of the toner core. The liquid A is a fine particle dispersion containing binder resin fine particles and release agent fine particles, or a fine particle dispersion containing fine particles including a binder resin and a release agent. The liquid A may further contain, if necessary, fine particles including a coloring agent (coloring agent fine particles). Besides, the fine particles contained in the liquid A (the binder resin fine particles, the release agent fine particles, or the fine particles including the binder resin and the release agent) may contain, if necessary, a component such as a coloring agent or a charge control agent. Now, a method for preparing a fine particle dispersion containing binder resin fine particles, a method for preparing a fine particle dispersion containing release agent fine particles, and a method for preparing a fine particle dispersion containing coloring agent fine particles will be described. It is noted that the methods for preparing these dispersions are not limited to those described below.

<Method for Preparing Fine Particle Dispersion containing Binder Resin Fine Particles>

A resin composition containing a binder resin, or a binder resin and an optionally component that may be contained in the toner core is roughly pulverized by using a pulverizing machine (such as a turbo mill) The thus obtained roughly pulverized product is dispersed in an aqueous medium such as ion-exchanged water, and the resulting aqueous medium is heated, to a temperature higher, by 10° C. or more, than the softening point of the binder resin, measured by using a flow tester, (specifically, to a temperature of approximately 200° C. at the most). To the thus heated aqueous medium containing the binder resin, a strong shearing force is applied by using a high-speed shearing emulsifier (such as Clearmix (manufactured by M Technique Co., Ltd.)), and thus, a fine particle dispersion containing binder resin fine particles is obtained.

The volume average particle size ($D_{50}$) of the binder resin fine particles is preferably 1 μm or less, and more preferably 0.05 μm or more and 0.5 μm or less. If the binder resin fine particles have a particle size falling in this range, a toner having a sharp particle size distribution and having a uniform particle shape can be easily obtained. Therefore, variation in the performance and productivity of the toner particles can be small. The volume average particle size ($D_{50}$) of the binder resin fine particles can be measured by using, for example, a laser diffraction particle size distribution analyzer (SALD-2200 (manufactured by Shimadzu Corporation)).

If a polyester resin is used as the binder resin, a basic material may be added to a mixture obtained in preparing the fine particle dispersion containing the binder resin fine particles for purpose of neutralizing an acid group contained in the polyester resin. The basic material is not especially limited as long as the acid group contained in the polyester resin can be neutralized. Examples of a suitably used basic compound include alkali metal hydroxides (such as sodium hydroxide, potassium hydroxide and lithium hydroxide), alkali metal carbonates (such as sodium carbonate and potassium carbonate), alkali metal hydrogencarbonates (such as sodium hydrogencarbonate and potassium hydrogencarbonate), and nitrogen-containing organic bases (such as N,N-dimethylethanolamine, N,N-diethylethanolamine, triethanolamine, tripropanolamine, tributanolamine, triethylamine, n-propylamine, n-butylamine, isopropylamine, monomethanolamine, morpholine, methoxypropylamine, pyridine and vinyl pyridine). One of these basic compounds may be singly used, or two or more of these may be used in combination.

The amount of the basic compound to be used is not especially limited as long as the object of the present disclosure is not impaired, and can be appropriately determined in consideration of the acid value of the polyester resin. Typically, the amount of the basic compound to be used is preferably 1 part by mass or more and 20 parts by mass or less, and more preferably 5 parts by mass or more and 15 parts by mass or less based on 100 parts by mass of the binder resin.

A surfactant may be added to the mixture obtained in preparing the fine particle dispersion containing the binder resin fine particles. If a surfactant is added, the binder resin fine particles can be stably dispersed in the aqueous medium.

The surfactant that may be added to the mixture obtained in preparing the fine particle dispersion containing the binder resin fine particles is not especially limited, but may be appropriately selected from the group consisting of an anionic surfactant, a cationic surfactant and a nonionic surfactant. Examples of the anionic surfactant include a sulfuric acid ester salt type surfactant, a sulfonic acid salt type surfactant, a phosphoric acid ester salt type surfactant, and soap. Examples of the cationic surfactant include an amine salt type surfactant and a quaternary ammonium salt type surfactant. Examples of the nonionic surfactant include a polyethylene glycol type surfactant, an alkylphenol ethylene oxide addition product type surfactant and a polyvalent alcohol type surfactant (such as derivative of polyvalent alcohol such as glycerin, sorbitol or sorbitan). Among these surfactants, at least one of the anionic surfactant and the nonionic surfactant is preferably used. One of the aforementioned surfactants may be singly used, or two or more of these may be used in combination.

The amount of the surfactant to be used is preferably 1% by mass or more and 10% by mass or less based on the total mass of the binder resin.

(Method for Preparing Fine Particle Dispersion Containing Release Agent Fine Particles)

A powder of a release agent is precedently obtained by pulverizing the release agent into a size of approximately 100 μm or less. The powder of the release agent is added to an aqueous medium containing a surfactant to prepare a slurry. The thus obtained slurry is heated to a temperature equal to or higher than the melting point of the release agent. To the heated slurry, a strong shearing force is applied by using a homogenizer or a pressure-ejecting type disperser, and thus, a fine particle dispersion containing release agent fine particles is prepared.

An apparatus for applying a strong shearing force to the slurry is, for example, NANO3000 (manufactured by Beryu Co., Ltd.), Nanomizer (manufactured by Yoshida Kikai Co., Ltd.), Microfluidizer (manufactured by MFI), Gaulin Homogenizer (manufactured by Manton Gaulin), or Clearmix W Motion (manufactured by M Technique Co., Ltd.).

The volume average particle size ($D_{50}$) of the fine particles including the release agent contained in the fine particle dispersion is preferably 1 μm or less, and more preferably 0.1 μm or more and 0.7 μm or less. If release agent fine particles having a particle size falling in this range are used, a toner core in which the release agent is homogeneously dispersed in the binder resin can be easily obtained. The volume average particle size ($D_{50}$) of the release agent fine particles can be measured by a similar method to the measurement method for the volume average particle size ($D_{50}$) of the binder resin fine particles.

(Method for Preparing Fine Particle Dispersion Containing Coloring Agent Fine Particles)

A coloring agent, and if necessary, a component such as a dispersant of the coloring agent, are dispersed in an aqueous medium containing a surfactant by using a known disperser. Thus, fine particles containing the coloring agent (coloring agent fine particles) are obtained. The type of the dispersant is not especially limited, and any of an anionic surfactant, a cationic surfactant and a nonionic surfactant may be used. The amount of the surfactant to be used is not especially limited, and is preferably equal to or larger than a critical micelle concentration (CMC).

The disperser used for dispersing the coloring agent is not especially limited, and for example, a pressure disperser (such as an ultrasonic disperser, a mechanical homogenizer, Manton Gaulin or a pressure homogenizer), a medium type disperser (such as a sand grinder, a horizontal or vertical bead mill, Ultra Apex Mill (manufactured by Kotobuki Industries Co., Ltd.), Dyno Mill (manufactured by WAB Company), or MSC mill (manufactured by Nippon Coke and Engineering Co., Ltd.)) can be used.

The volume average particle size ($D_{50}$) of the fine particles containing the coloring agent is preferably 0.05 μm or more and 0.2 μm or less.

Liquid B

The liquid B contains an aggregating agent. The aggregating agent contained in the liquid B is not especially limited as long as the fine particles that are contained in the liquid A and contain the components of the toner core can be satisfactorily aggregated. Examples of the aggregating agent contained in the liquid B include an inorganic metal salt and an inorganic ammonium salt. Examples of the inorganic metal salt include metal salts (such as sodium sulfate, sodium chloride, potassium chloride, potassium nitrate, barium chloride, magnesium chloride, zinc chloride, aluminum chloride and aluminum sulfate) and inorganic metal salt polymers (such as polyaluminum chloride and polyaluminum hydroxide). Examples of the inorganic ammonium salt include ammonium sulfate, ammonium chloride and ammonium nitrate. Alternatively, a quaternary ammonium salt type cation surfactant or polyethylene imine may be used as the aggregating agent. Besides, a solvent for dissolving the aggregating agent therein is not especially limited as long as the aggregating agent can be satisfactorily dissolved.

Among these aggregating agents, a bivalent metal salt or a monovalent metal salt is particularly preferably used.

As the solvent for dissolving the aggregating agent, a solvent that has high solubility for the aggregating agent and minimally dissolves the resin contained in the resin fine particles is preferably used. Preferable examples of such a solvent include water and alcohols (such as methanol and ethanol).

For purpose of controlling the shape of the toner core, the liquid A or the liquid B may be mixed with at least one selected from known organic solvents, polymer compounds and surfactants.

According to the method for producing the toner core described so far, toner cores having a sharp particle size distribution and having a desired particle size can be produced in a short period of time.

[Shell Layer]

The material of the shell layer is not especially limited as long as toner particles having the hardness $H_{10}$ and $H_{100}$ respectively falling in the prescribed ranges can be produced. The material of the shell layer is generally a resin material. Examples of the resin material suitably used as the material of the shell layer include (meth)acrylic resins and styrene-(meth)acrylic resins. Now, a (meth)acrylic resin and a styrene-(meth)acrylic resin, which are preferable materials of the shell layer, and a method for forming the shell layer will be described.

[(Meth)Acrylic Resin]

If a (meth)acrylic resin is used as the resin forming the shell layer, the (meth)acrylic resin is a resin obtained by polymerizing a monomer at least containing a (meth)acrylic monomer. Examples of the (meth)acrylic monomer used for preparing the (meth)acrylic resin include (meth)acrylic acid, alkyl (meth)acrylates (such as methyl (meth)acrylate, ethyl (meth)acrylate and propyl (meth)acrylate), and (meth)acrylamide compounds (such as (meth)acrylamide, N-alkyl (meth)acrylamide, N-aryl (meth)acrylamide, N,N-dialkyl (meth)acrylamide and N,N-diaryl (meth)acrylamide).

If the (meth)acrylic resin is a resin obtained by copolymerizing a (meth)acrylic monomer and a monomer other than the (meth)acrylic monomer, examples of this monomer include olefins (such as ethylene, propylene, butene-1, pentene-1, hexene-1, heptene-1 and octene-1), allyl esters (such as allyl acetate, allyl benzoate, allyl acetoacetate and allyl lactate), vinyl ethers (such as hexyl vinyl ether, octyl vinyl ether, ethylhexyl vinyl ether, methoxyethyl vinyl ether, ethoxyethyl vinyl ether, chloroethyl vinyl ether, 2-ethylbutyl vinyl ether, dimethylamino ethyl vinyl ether, diethylamino ethyl vinyl ether, benzyl vinyl ether, vinyl phenyl ether, vinyl tolyl ether, vinyl chlorophenyl ether, vinyl-2,4-dichlorophenyl ether, and vinyl naphthyl ether), and vinyl esters (such as vinyl acetate, vinyl propionate, vinyl butyrate, vinyl isobutyrate, vinyl diethyl acetate, vinyl chloroacetate, vinyl methoxy acetate, vinyl butoxy acetate, vinyl phenyl acetate, vinyl acetoacetate, vinyl lactate, vinyl benzoate, vinyl salicylate, vinyl chlorobenzoate, and vinyl naphthoate).

Similarly to the above-described resin usable as the charge control agent, a chargeable functional group such as a quaternary ammonium salt may be introduced into the (meth) acrylic resin.

The total content of a (meth)acrylic monomer-derived unit contained in the (meth)acrylic resin is preferably 80% by mass or more, more preferably 90% by mass or more, and particularly preferably 100% by mass.

[Styrene-(Meth)Acrylic Resin]

If a styrene-(meth)acrylic resin is used as the resin forming the shell layer, the styrene-(meth)acrylic resin is a resin obtained by copolymerizing monomers at least including a styrene monomer and a (meth)acrylic monomer.

Examples of the styrene monomer used for preparing the styrene-(meth)acrylic resin include styrene, α-methyl styrene, o-methyl styrene, m-methyl styrene, p-methyl styrene, p-ethyl styrene, 2,4-dimethylstyrene, p-n-butylstyrene, p-dodecylstyrene, p-methoxystyrene, p-phenylstyrene and p-chlorostyrene.

Examples of the (meth)acrylic monomer used for preparing the styrene-(meth)acrylic resin are the same as those usable for preparing the (meth)acrylic resin described above.

If the styrene-(meth)acrylic resin is a resin obtained by copolymerizing a styrene monomer, a (meth)acrylic monomer and a monomer other than the styrene monomer and the (meth)acrylic monomer, examples of this monomer are the same as those of this monomer other than the (meth)acrylic monomer usable for preparing the (meth)acrylic resin described above.

The total content of a styrene monomer-derived unit and a (meth)acrylic monomer-derived unit contained in the styrene-(meth)acrylic resin is preferably 80% by mass or more, more preferably 90% by mass or more, and particularly preferably 100% by mass.

Similarly to the above-described resin usable as the charge control agent, a chargeable functional group such as a quaternary ammonium salt may be introduced into the styrene-(meth)acrylic resin.

The glass transition point ($Tg_2$) of the resin forming the shell layer is preferably 50° C. or more and 70° C. or less, and more preferably 55° C. or more and 65° C. or less. If the shell layer is formed by using a resin having the glass transition point $Tg_2$ falling in this range, toner particles excellent in the low-temperature fixability and the storage stability can be easily obtained. The glass transition point of the resin forming the shell layer can be measured by a similar method to that employed for measuring the glass transition point ($Tg_1$) of the binder resin described above.

The melting point of the resin forming the shell layer is not especially limited as long as the object of the present disclosure is not impaired. Typically, the melting point ($Tm_2$) of the resin forming the shell layer is preferably 100° C. or more and 155° C. or less, and more preferably 120° C. or more and 150° C. or less. If the melting point of the resin forming the shell layer is too high, the resulting toner is difficult to satisfactorily fix at a low temperature. If the melting point of the resin forming the shell layer is too low, the high-temperature preservability of the resulting toner is degraded. The melting point of the resin forming the shell layer can be measured by using a differential scanning calorimeter (DSC).

The number average molecular weight ($Mn_2$) of the resin forming the shell layer is preferably 5,000 or more and 500, 000 or less, and more preferably 10,000 or more and 100,000 or less. The mass average molecular weight ($Mw_2$) of the resin forming the shell layer is preferably 10,000 or more and 1,000,000 or less, and more preferably 30,000 or more and 500,000 or less. Besides, a molecular weight distribution ($Mw_2/Mn_2$) expressed as a ratio between the number average molecular weight ($Mn_2$) and the mass average molecular weight ($Mw_2$) is preferably 2 or more and 10 or less. If the resin forming the shell layer has a molecular weight distribution falling in this range, a toner excellent in the storage stability can be easily obtained. The number average molecular weight ($Mn_2$) and the mass average molecular weight ($Mw_2$) of the resin forming the shell layer can be measured by the gel permeation chromatography.

The mass of the shell layer is preferably 2 parts by mass or more and 10 parts by mass or less based on 100 parts by mass of the toner core.

[Method for Forming Shell Layer]

The method for forming the shell layer is not especially limited as long as toner particles having the hardness $H_{10}$ and $H_{100}$ respectively falling in the prescribed ranges can be produced. The shell layer may be formed by a dry method or a wet method. Preferably, the shell layer is formed by a wet method because the shell layer can be thus easily formed on the surface of the toner core in a uniform thickness. Now, the dry method and the wet method that may be employed for forming the shell layer will be described.

(Dry Method)

In the dry method, for example, resin fine particles for forming the shell layer (hereinafter sometimes simply referred to as the resin fine particles) are supplied to toner cores stirred in the dry state, so as to adhere the resin fine particles to the surfaces of the toner cores, and thus, the shell layer is formed on the surface of each toner core. In this case, the toner cores in the dry state are preferably dispersed in a gas phase. Besides, the resin fine particles are preferably supplied in the state of, for example, a suspension in an aqueous medium.

An apparatus used for forming the shell layer on the surface of the toner core by the dry method is not especially limited as long as an air stream capable of stirring the toner cores in the dry state can be caused and an emulsion containing the resin fine particles can be sprayed to the toner cores dispersed in the air stream. A specific example of such an apparatus includes a surface modifying apparatus (such as a fine particle coating apparatus (manufactured by Powrex Corp.)).

(Wet Method)

In the wet method, resin fine particles for forming the shell layer are added to a suspension of toner cores dispersed in an aqueous medium, and the resulting suspension containing the toner cores and the resin fine particles is stirred, so as to adhere the resin fine particles to the surfaces of the toner cores. In stirring the suspension containing the toner cores and the resin fine particles in the wet method, the suspension is preferably heated.

In the wet method, the resin fine particles are first added to the suspension of the toner cores in the aqueous medium. The resin fine particles may be a powder in the dry state or in the form of a suspension in an aqueous medium. The resin fine particles are preferably used in the form of a suspension in an aqueous medium. This is because the resin fine particles can be thus rapidly dispersed in the suspension of the toner cores in the aqueous medium.

After mixing the toner cores and the resin fine particles in the aqueous medium, the suspension containing the toner cores and the resin fine particles is preferably stirred under heating. The temperature to which the suspension containing the toner cores and the resin fine particles is heated is not especially limited as long as the object of the present disclosure is not impaired. Typically, the suspension containing the toner cores and the resin fine particles is heated preferably to a temperature that is equal to or higher than the glass transition point ($Tg_2$) of the resin fine particles and is equal to or lower than the melting point ($Tm_2$) of the resin fine particles. When the suspension is heated to a temperature within this range, the resin fine particles adhered to the surfaces of the toner cores are thermally deformed into a film, and toner particles in a uniform shape can be thus easily prepared. In this manner, the shell layer covering the surface of the toner core is formed, so as to obtain the toner particle to be contained in the electrostatic latent image developing toner.

The toner particles thus obtained are collected from the suspension by filtration, and are washed with water if necessary. The filtered toner particles are dried under conditions where the particles are neither aggregated nor deformed by heat.

[External Additive]

The toner particle contained in the toner of the present disclosure may have a surface treated by an external additive as occasion demands. Herein, a toner particle to be treated with an external additive is designated as a "toner mother particle". The type of external additive is not especially limited as long as the object of the present disclosure is not impaired, and the external additive may be appropriately selected from those conventionally used for toners. Specific examples of a suitable external additive include silica and metal oxides (such as alumina, titanium oxide, magnesium oxide, zinc oxide, strontium titanate and barium titanate). Two or more of these external additives may be used in combination. Besides, such an external additive may be hydrophobized for use by using a hydrophobizing agent such as an amino silane coupling agent or a silicone oil. If a hydrophobized external additive is used, lowering of the charge amount of the resulting toner at a high temperature and high humidity can be easily suppressed, and the toner can easily attain excellent fluidity.

Typically, the particle size of the external additive is preferably 0.01 μm or more and 1.0 μm or less.

Typically, the amount of the external additive to be used is preferably 0.1 part by mass or more and 10 parts by mass or less, and more preferably 0.2 part by mass or more and 5 parts by mass or less based on 100 parts by mass of the toner mother particles.

The method for treating the toner mother particle with the external additive is not especially limited, but any of known treatment methods using external additives may be appropriately selected. Specifically, the treatment with an external additive is performed by using a mixer such as a Henschel mixer or a Nauta mixer under treatment conditions adjusted so that a particle of the external additive cannot be embedded in the toner mother particle.

[Carrier]

The toner of the present disclosure can be mixed with a desired carrier to be used as a two-component developer. In preparing a two-component developer, a magnetic carrier is preferably used.

An example of a carrier suitably used to prepare the two-component developer by using the toner of the present disclosure includes one obtained by coating a carrier core with a resin. Specific examples of the carrier core include a particle of a material such as iron, iron subjected to oxidation, reduced iron, magnetite, copper, silicon steel, ferrite, nickel or cobalt; a particle of an alloy of such a material and manganese, zinc or aluminum; a particle of an iron-nickel alloy or an iron-cobalt alloy; a particle of a ceramic such as titanium oxide, aluminum oxide, copper oxide, magnesium oxide, lead oxide, zirconium oxide, silicon carbide, magnesium titanate, barium titanate, lithium titanate, lead titanate, lead zirconate or lithium niobate; a particle of a high-dielectric constant material such as ammonium dihydrogen phosphate, potassium dihydrogen phosphate or Rochelle salt; and a resin carrier core containing any of these magnetic particles dispersed in a resin.

Specific examples of the resin coating the carrier core include (meth)acrylic polymers, styrene polymers, styrene-(meth)acrylic copolymers, olefin polymers (such as polyethylene, chlorinated polyethylene and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (such as polytetrafluoroethylene, polychlorotrifluoroethylene and polyvinylidene fluoride), phenol resins, xylene resins, diallyl phthalate resins, polyacetal resins and amino resins. Two or more of these resins may be used in combination.

The carrier has a particle size, measured by using an electron microscope, of preferably 20 μm or more and 120 μm or less, and more preferably 25 μm or more and 80 μm or less.

If the toner of the present disclosure is used as the two-component developer, the content of the toner in the two-component developer is preferably 3% by mass or more and 20% by mass or less, and more preferably 5% by mass or more and 15% by mass or less based on the whole mass of the two-component developer. When the content of the toner in the two-component developer falls in this range, the image density of images formed by the developer can be easily kept at an appropriate level. Besides, the toner can be prevented from scattering from the developing unit, so as to suppress staining of the inside of the image forming apparatus and adhesion of the toner onto transfer paper.

The electrostatic latent image developing toner of the present disclosure described so far is excellent in the storage stability and the low-temperature fixability, and can suppress the occurrence of an offset at a high temperature, degradation in quality of formed images due to adhesion of the toner to the developing sleeve or the photoconductive drum, and the occurrence of fogging in the formed images. Accordingly, the electrostatic latent image developing toner of the present disclosure is suitably used in a variety of image forming apparatuses.

EXAMPLES

Specific examples of the present disclosure will now be described. It is noted that the present disclosure is not limited to these examples.

Preparation Example 1

Preparation of Fine Particle Dispersion Containing Polyester Resin Fine Particles Fine particle dispersions R-1 to R-3 respectively containing polyester resin fine particles shown in Table 1 below were prepared by using polyester resins r-1 to r-3 described later.

Each of the polyester resins was roughly pulverized by using a turbo mill T250 (manufactured by Turbo Kogyo KK) to give a roughly pulverized product having an average particle size of approximately 10 μm. A hundred g of this roughly pulverized product, 2 g of an anionic dispersant (Emal E27C (manufactured by Kao Corporation)) and 50 g of a 0.1 N sodium hydroxide aqueous solution were mixed. To the thus obtained mixture, ion-exchanged water was further added to prepare a slurry in a total amount of 500 g. The thus prepared slurry was put in a round-bottom pressure vessel of stainless steel. Subsequently, the slurry was subjected to shear dispersion, by using a high-speed shearing emulsifier, Clearmix (CLM-2.2S (manufactured by M Technique Co., Ltd.)) at a temperature of 140° C., a pressure of 0.5 MPa (G), and a rotor rotational speed of 20,000 rpm for 30 minutes. Thereafter, with stirring continued at a rotor rotational speed of 15,000 rpm, the slurry was cooled until the inside temperature of the stainless steel vessel was lowered to 50° C. at a temperature decreasing rate of 5° C./min To the slurry thus cooled to room temperature, ion-exchanged water was added to attain a solid content concentration of 20% by mass based on the whole mass of the dispersion, and thus, the fine particle dispersion containing the polyester resin fine particles was obtained.

<Polyester Resin r-1>

The polyester resin r-1 was an amorphous polyester resin having the following physical properties:

Number average molecular weight ($Mn_1$): 2,000
Mass average molecular weight ($Mw_1$): 6,000
Molecular weight distribution ($Mw_1/Mn_1$): 3.0
Melting point ($Tm_1$): 70.8° C.
Glass transition point ($Tg_1$): 38.4° C.
Acid value: 11.6 mgKOH/g <Polyester Resin r-2>

The polyester resin r-2 was an amorphous polyester resin having the following physical properties:

Number average molecular weight ($Mn_1$): 2,200
Mass average molecular weight ($Mw_1$): 6,300
Molecular weight distribution ($Mw_1/Mn_1$): 2.9
Melting point ($Tm_1$): 80.4° C.
Glass transition point ($Tg_1$): 46.0° C.
Acid value: 10.9 mgKOH/g <Polyester Resin r-3>

The polyester resin r-3 was an amorphous polyester resin having the following physical properties:

Number average molecular weight ($Mn_1$): 2,500
Mass average molecular weight ($Mw_1$): 6,600
Molecular weight distribution ($Mw_1/Mn_1$): 2.6
Melting point ($Tm_1$): 107.3° C.
Glass transition point ($Tg_1$): 65.2° C.
Acid value: 10.7 mgKOH/g

TABLE 1

| Fine particle dispersion | Polyester resin | | | |
|---|---|---|---|---|
| | Type | Glass transition point ($Tg_1$) [° C.] | Melting point ($Tm_1$) [° C.] | Acid value [mgKOH/g] |
| R-1 | r-1 | 38.4 | 70.8 | 11.6 |
| R-2 | r-2 | 46.0 | 80.4 | 10.9 |
| R-3 | r-3 | 65.2 | 107.3 | 10.7 |

Preparation Example 2

Preparation of Fine Particle Dispersion Containing Release Agent Fine Particles A mixture was obtained by mixing 200 g of a release agent (WEP-5, pentaerythritol behenate wax, having a melting temperature of 84° C. (manufactured by NOF Corporation)), 2 g of an anionic surfactant (Emal E27C (manufactured by Kao Corporation)) and 800 g of ion-exchanged water. The mixture was heated to 100° C. for melting the release agent therein, and the resulting mixture was emulsified for 5 minutes by using a homogenizer (ULTRA-TURRAX T50 (manufactured by IKA)). The resulting mixture was further emulsified at 100° C. by using Gaulin Homogenizer (manufactured by Manton Gaulin). In this manner, a fine particle dispersion containing release agent fine particles having an average particle size of 250 nm and a melting point of 83° C. and having a solid content concentration of 20% by mass was obtained.

Preparation Example 3

Preparation of Fine Particle Dispersion Containing Color Agent Fine Particles

A mixture was obtained by mixing 90 g of a cyan coloring agent (C.I. Pigment Blue 15:3 (copper phthalocyanine)), 10 g of an anionic surfactant (sodium dodecyl sulfate) and 400 g of ion-exchanged water. The mixture was emulsified and dispersed for 1 hour by using a high-pressure impact disperser, Ultimizer (HJP30006 (manufactured by Sugino Machine Limited)), and thus, a fine particle dispersion containing coloring agent fine particles and having a solid content concentration of 15% by mass was obtained.

The particle size distribution of the coloring agent fine particles contained in the fine particle dispersion prepared as described above was measured by using a particle size distribution analyzer (Microtrac UPA 150 (manufactured by Nikkiso Co., Ltd.)). The volume average particle size (MV) of the coloring agent fine particles contained in the fine particle dispersion prepared as above was 160 nm, and a Cv value of the particle size distribution was 25%. Besides, it was confirmed, on the basis of a TEM image of the coloring agent fine particles, that the roundness of the coloring agent fine particles was 0.800.

Preparation Example 4

Preparation of Fine Particle Dispersion Containing Acrylic Resin Fine Particles

Fine particle dispersions S-1 to S-5 containing acrylic resin fine particles for forming a shell layer were prepared in the same manner as in the preparation of the fine particle dispersions containing the polyester resin fine particles except that acrylic resins s-1 to s-5 described later were used instead of the polyester resins r-1 to r-3. With respect to the fine particle dispersions S-1 to S-5, particle sizes of the acrylic resin fine particles contained in the fine particle dispersions for forming a shell layer and solid content concentrations in the fine particle dispersions are shown in Table 2. Incidentally, the particle sizes of the acrylic resin fine particles were measured by using a particle size analyzer (LA-950 (manufactured by Horiba Ltd.)).

<Acrylic Resin s-1>

The acrylic resin s-1 was an acrylic resin powder having the following physical properties:

Number average molecular weight ($Mn_2$): 100,000
Mass average molecular weight ($Mw_2$): 500,000
Molecular weight distribution ($Mw_2/Mn_2$): 5.0
Melting point ($Tm_2$): 147.9° C.
Glass transition point ($Tg_2$): 62.9° C.

<Acrylic Resin s-2>

The acrylic resin s-2 was an acrylic resin powder having the following physical properties:

Number average molecular weight ($Mn_2$): 30,000
Mass average molecular weight ($Mw_2$): 100,000
Molecular weight distribution ($Mw_2/Mn_2$): 3.3
Melting point ($Tm_2$): 123.4° C.
Glass transition point ($Tg_2$): 63.0° C.

<Acrylic Resin s-3>

The acrylic resin s-3 was an acrylic resin powder having the following physical properties:

Number average molecular weight ($Mn_2$): 200,000
Mass average molecular weight ($Mw_2$): 500,000
Molecular weight distribution ($Mw_2/Mn_2$): 2.5
Melting point ($Tm_2$): 147.9° C.
Glass transition point ($Tg_2$): 62.9° C.

<Acrylic Resin s-4>

The acrylic resin s-4 was an acrylic resin powder having the following physical properties:

Number average molecular weight ($Mn_2$): 7,000
Mass average molecular weight ($Mw_2$): 20,000
Molecular weight distribution ($Mw_2/Mn_2$): 2.9
Melting point ($Tm_2$): 115.5° C.
Glass transition point ($Tg_2$): 60.0° C.

<Acrylic Resin s-5>

The acrylic resin s-5 was an acrylic resin powder having the following physical properties:

Number average molecular weight ($Mn_2$): 250,000
Mass average molecular weight ($Mw_2$): 800,000
Molecular weight distribution ($Mw_2/Mn_2$): 3.2
Melting point ($Tm_2$): 155.5° C.
Glass transition point ($Tg_2$): 63.0° C.

TABLE 2

| | Acrylic resin | | | Number | |
|---|---|---|---|---|---|
| Fine particle dispersion | Type | Glass transition point ($Tg_2$) [° C.] | Melting point ($Tm_2$) [° C.] | average particle size [nm] | Solid content concentration [mass %] |
| S-1 | s-1 | 62.9 | 147.9 | 135 | 19.9 |
| S-2 | s-2 | 63.0 | 123.4 | 126 | 19.8 |
| S-3 | s-3 | 62.9 | 147.9 | 135 | 14.9 |
| S-4 | s-4 | 60.0 | 115.5 | 120 | 20.8 |
| S-5 | s-5 | 63.0 | 155.5 | 120 | 20.0 |

Preparation Example 5

Preparation of Silica

A hundred g of dimethylpolysiloxane (manufactured by Shin-Etsu Chemical Co., Ltd.) and 100 g of 3-aminopropyl trimethoxysilane (manufactured by Shin-Etsu Chemical Co., Ltd.) were dissolved in 200 g of toluene. The thus obtained solution was diluted 10-fold. Subsequently, the diluted solution of the dimethylpolysiloxane and the 3-aminopropyl trimethoxysilane was slowly added dropwise to 200 g of fumed silica, Aerosil #90 (manufactured by Nippon Aerosil Co., Ltd.) with stirring, and then mixed with stirring under ultrasonic irradiation for 30 minutes. The thus obtained mixture was heated in a thermostat at 150° C., and then, toluene was distilled off by using a rotary evaporator to give a solid matter. The solid matter was dried by using a vacuum drier with a temperature set to 50° C. until no more weight loss was observed. The resultant solid matter was further treated by using an electric furnace at 200° C. for 3 hours under nitrogen flow, so as to give a silica coarse powder. The thus obtained silica coarse powder was crushed by using a jet mill (IDS type jet mill (manufactured by Nippon Pneumatic Mfg. Co., Ltd.)) and collected by a bug filter, and thus, silica was obtained.

Examples 1 to 3 and 5 and Comparative Examples 3 and 4

Toner Core Preparation Process

Aggregation Method using Microreactor

In each of Examples 1 to 3 and 5 and Comparative Examples 3 and 4, a toner core dispersion was prepared by the aggregation method using a microreactor (ULREA SS-11 (M Technique Co., Ltd.)).

A fine particle dispersion that contains a corresponding type of polyester resin fine particles shown in Table 3 or 4 as a binder resin, the fine particle dispersion containing the release agent fine particles prepared in Preparation Example 2 and the fine particle dispersion containing the coloring agent fine particles prepared in Preparation Example 3 were mixed so that a mass ratio in solid content among the binder resin, the release agent and the coloring agent (i.e., a binder resin/release agent/coloring agent ratio) of 100/10/5 could be attained. To the thus obtained mixture, ion-exchanged water was added to attain a solid content concentration of 5% by mass, and the thus prepared mixture was used as a first unprocessed liquid. With the microreactor set to setting conditions described below, the first unprocessed liquid was supplied from a first unprocessed liquid supply section x under conditions described below. Besides, a magnesium chloride ($MgCl_2$) aqueous solution (in a concentration of 5% by mass) was supplied as an aggregating agent for the fine particles from a second unprocessed liquid supply section y under conditions described below. Thereafter, a dispersion containing toner cores was obtained at a liquid exit port z having a cooling jacket. Incidentally, the pH value of the first unprocessed liquid was precedently adjusted to 9 by adding triethanolamine thereto.

<Setting Conditions>

Back Pressure: 0.08 MPa (G)

Process Supply Pressure: 0.3 MPa (G)

Disc Rotational Speed: 1,000 rpm

<Conditions for First Unprocessed Liquid Supply Section>

Liquid Temperature: 70° C.

Flow Rate: 50 ml/min

<Conditions for Second Unprocessed Liquid Supply Section>

Liquid Temperature: 60° C.

Flow Rate: 20 ml/min

[Shell Layer Formation Process: Wet Method]

Into a stainless steel beaker with a volume of 1000 ml, 800 g of the thus obtained dispersion containing toner cores (in a solid content concentration of 20% by mass) and 38 g of a corresponding fine particle dispersion containing resin fine particles shown in Table 3 or 4 were put.

Subsequently, the content of the beaker was heated, by using a heating oil bath, to a corresponding temperature shown in Table 3 or 4 at a rate of 0.2° C./min under stirring at a stirring speed of 60 rpm by using a stirring machine (mechanical stirrer RW20 (manufactured by IKA)). Subsequently, with the stirring speed changed to 300 rpm (which was kept at the same speed until the stirring was stopped), the stirring was continued at a corresponding temperature shown in Table 3 or 4 for a corresponding time period shown in Table 3 or 4, so that the resin fine particles could be adhered to the surfaces of the toner cores. Thereafter, 50 g of a sodium chloride aqueous solution in a concentration of 20% by mass was added to the content of the beaker, so as to stop the proceeding of the adhesion of the rein fine particles to the surfaces of the toner cores.

Subsequently, the temperature of the content of the beaker was increased to 75° C. at a rate of 0.2° C./min Thereafter, the content was stirred at 75° C. for 120 minutes, so as to allow the resin fine particles having been adhered to the surfaces of the toner cores to be a film. Thereafter, the temperature of the content of the beaker was decreased to 25° C. at a rate of 10° C./min, and thus, a dispersion containing toner mother particles was obtained.

[Washing Process]

A wet cake of the toner mother particles was filtered out by using a Buchner funnel from the dispersion containing the toner mother particles. The wet cake of the toner mother particles was dispersed again in ion-exchanged water for washing the toner mother particles. Similar washing of the toner mother particles using ion-exchanged water was repeated five times.

[Drying Process]

The wet cake of the toner mother particles was dispersed in an ethanol aqueous solution (in a concentration of 50% by mass) to prepare a slurry. The thus obtained slurry was dried, by using a continuous surface modifying apparatus (Coatmizer (manufactured by Freund Industrial Co., Ltd.)), at a hot air temperature of 40° C. and a blower air flow rate of 2 $m^3$/min for 72 hours, and thus, toner mother particles having a volume average particle size and average roundness shown in Table 3 or 4 were obtained.

[External Addition Process]

A hundred g of the thus obtained toner mother particles and 2 g of the silica obtained in Preparation Example 5 were mixed for 5 minutes by using a Henschel mixer (manufactured by Mitsui Miike Machinery Co., Ltd., having a volume of 5 L). Thereafter, the thus obtained mixture was sifted by using a sieve (#300 mesh, having a sieve opening of 48 μm), and thus, a toner of each of Examples 1 to 3 and 5 and Comparative Examples 3 and 4 was obtained.

Example 4

Toner Core Preparation Process

Aggregation Method Using Microreactor

Toner cores were prepared in the same manner as in the preparation of the toner of Example 1, and a dispersion containing the toner cores was prepared.

[Washing Process and Drying Process]

The resultant dispersion containing the toner cores was subjected to the washing process and the drying process performed in the same manner as the washing process and the drying process of Example 1, and thus, toner cores were obtained.

[Shell Layer Formation Process: Dry Method]

A surface modifying apparatus (a fine particle coating machine, SFP-01 (manufactured by Powrex Corp.)) was used for forming a shell layer. A hundred g of the toner cores were allowed to circulate through a fluidized bed of the surface modifying apparatus at a feed air temperature of 80° C. Compressed air was sent to a spray nozzle at 25 nL/min so as to spray 40 ml of a corresponding type of resin fine particle dispersion shown in Table 3 at a spray rate of 5 ml/min into the fluidized bed of the surface modifying apparatus. A first stirring blade was rotated at a circumferential speed of 0.75 m/s, and a distance between the first stirring blade and a mesh screen was set to 0.5 mm. The mesh screen had a thickness of 1 mm, an aperture of 50%, and a pore size of 1 mm After 8 minutes, toner mother particles having a volume average particle size and average roundness shown in Table 3 were taken out of the fine particle coating machine in which the supply of the spray solution had been completed.

[External Addition Process]

The thus obtained toner mother particles were subjected to the external addition process in the same manner as the toner of Example 1, and thus, a toner of Example 4 was obtained.

Comparative Example 1

Toner Core Preparation Process

Aggregation Method Using Stirring Blade

Into a round-bottom flask with a volume of 2 L equipped with a stirring blade as a stirrer, 500 g of a corresponding fine particle dispersion containing a corresponding type of polyester resin fine particles shown in Table 4, 68 g of the fine particle dispersion containing the release agent fine particles prepared in Preparation Example 2, and 33 g of the fine particle dispersion containing the coloring agent fine particles prepared in Preparation Example 3 were put to be mixed at 25° C. Subsequently, while stirring the content of the flask with the stirring blade (R1345 stirring blade (manufactured by IKA), 4-bladed propeller-type impeller) at a speed of 100 rpm, a 1N sodium hydroxide aqueous solution was added to the flask to adjust the pH of the resulting mixture to 11. Thereafter, the content of the flask was stirred at 25° C. and 120 rpm for 10 minutes, and then, 17 g of an aggregating agent (a magnesium chloride aqueous solution in a concentration of 50% by mass) was added thereto over 5 minutes under stirring. After adding the aggregating agent, the temperature within the flask was increased to 50° C. at a temperature increasing rate of 0.2° C./min under stirring. After increasing the temperature to 50° C., the content of the flask was stirred at the same temperature and 120 rpm for 30 minutes. Subsequently, after changing the speed of the stirring blade to 200 rpm, the temperature within the flask was increased to 55° C. at a temperature increasing rate of 0.2° C./min, and the content of the flask was stirred at the same temperature for 60 minutes to aggregate the fine particles. Thus, a dispersion containing toner cores as fine particle aggregates was obtained.

[Shell Layer Formation Process, Washing Process and Drying Process]

The dispersion containing the toner cores thus obtained was subjected to the shell layer formation process, the washing process and the drying process in the same manner as the toner of Example 1, and thus, toner mother particles having a volume average particle size and average roundness as shown in Table 4 were obtained.

[External Addition Process]

The toner mother particles thus obtained were subjected to the external addition process in the same manner as the toner of Example 1, and thus, a toner of Comparative Example 1 was obtained.

Comparative Example 2

Toner Core Preparation Process

Aggregation Method Using Microreactor

The toner core preparation process was performed in the same manner as that for the toner of Example 1, and a dispersion containing toner cores was obtained.

[Washing Process and Drying Process]

The dispersion containing the toner cores thus obtained was subjected, as a dispersion containing toner mother particles, to the washing process and the drying process in the same manner as the toner of Example 1, and thus, toner mother particles having a volume average particle size and average roundness as shown in Table 4 were obtained.

[External Addition Process]

The toner mother particles thus obtained were subjected to the external addition process in the same manner as the toner of Example 1, and thus, a toner of Comparative Example 2 was obtained.

In Tables 3 and 4, Preparation method A mentioned as a preparation method for toner cores refers to the aggregation method using a microreactor. Preparation method B refers to the aggregation method using a stirring blade.

TABLE 3

| Examples | 1 | 2 | 3 | 4 | 5 |
|---|---|---|---|---|---|
| Toner core preparation process | | | | | |
| Preparation method | A | A | A | A | A |
| Polyester resin fine particle dispersion | R-1 | R-2 | R-2 | R-1 | R-1 |
| Shell layer formation process | | | | | |
| Formation method | wet | wet | wet | dry | wet |
| Fine particle dispersion | S-1 | S-2 | S-1 | S-3 | S-4 |
| Temperature [° C.] | 60 | 70 | 60 | — | 70 |
| Stirring time [min] | 120 | 180 | 120 | — | 180 |
| Toner mother particles | | | | | |
| Volume average particle size [μm] | 5.11 | 5.21 | 5.01 | 5.15 | 5.14 |
| Average roundness | 0.975 | 0.974 | 0.978 | 0.979 | 0.981 |

TABLE 4

| Comparative Example | 1 | 2 | 3 | 4 |
|---|---|---|---|---|
| Toner core particle preparation process | | | | |
| Preparation method | B | A | A | A |
| Polyester resin fine particle dispersion | R-1 | R-1 | R-2 | R-1 |
| Shell layer formation process | | | | |
| Formation method | wet | — | wet | wet |
| Fine particle dispersion | S-1 | — | R-4 | S-5 |
| Temperature [° C.] | 60 | — | 65 | 65 |
| Stirring time [min] | 120 | — | 90 | 90 |
| Toner mother particles | | | | |
| Volume average particle size [μm] | 5.32 | 5.11 | 5.25 | 5.25 |
| Average roundness | 0.976 | 0.950 | 0.968 | 0.968 |

<<Hardness Measuring Method>>

The hardness $H_{10}$ and the hardness $H_{100}$ of the toners of Examples 1 to 5 and Comparative Examples 1 to 4 were measured by using, as a measuring apparatus, a nanoindentation hardness tester (Nanoindenter, ENT-2100 (manufactured by Elionix Inc.)) in accordance with the above-described method. The measurement results are shown in Tables 5 and 6.

<<Evaluation 1>>

The high-temperature preservability of the toners of Examples 1 to 5 and Comparative Examples 1 to 4 was evaluated by a method described below. The evaluation results for the high-temperature preservability of the toners of Examples 1 to 5 and Comparative Examples 1 to 4 are shown in Tables 5 and 6.

<High-Temperature Preservability>

Three g of each toner was weighed in a plastic container of 20 g, and the resultant was put in an oven to be heated at 60° C. for 3 hours, and then taken out. The toner having been taken out of the oven was allowed to stand still for 30 minutes under an environment of a temperature of 25° C. and humidity of 65%. Thereafter, the resulting toner was placed on three overlaid sieves respectively having sieve openings of 105 μm, 63 μm and 45 μm, and was shook, by using a powder tester (manufactured by Hosokawa Micron KK), with a vibration scale of 5 for 30 seconds, and the degree of aggregation of the toner attained after high-temperature storage was calculated in accordance with the following formulas:

$$\text{(Mass remaining on 105 μm sieve)}/3\times100 \quad (a)$$

$$\text{(Mass remaining on 63 μm sieve)}/3\times100\times3/5 \quad (b)$$

$$\text{(Mass remaining on 45 μm sieve)}/3\times100\times1/5 \quad (c)$$

$$\text{Degree of aggregation (\%)}=(a)+(b)+(c)$$

The high-temperature preservability was evaluated based on the following criteria:

Good (G): The degree of aggregation was less than 2%.

Normal (N): The degree of aggregation was 2% or more and less than 15%.

Poor (P): The degree of aggregation was 15% or more.

<<Evaluation 2>>

The fixability, the adhesion to other members and image fogging of each of the toners of Examples 1 to 5 and Comparative Examples 1 to 4 were evaluated. It is noted that the evaluation of the fixability, the adhesion to other members and the image fogging were performed by using a two-component developer prepared as described below. The evaluation results of the toners of Examples 1 to 5 and Comparative Examples 1 to 4 are shown in Tables 5 and 6.

Preparation Example 6

Preparation of Two-Component Developer

A two-component developer was prepared by mixing 300 g of a carrier and 30 g of the toner of each example or comparative example, which had been weighed in a plastic bottle with a volume of 500 ml, for 30 minutes by using a Turbula mixer (T2F (manufactured by Shinmaru Enterprises Corporation)).

<Fixability>

For evaluating the fixability, the low-temperature fixability, the high-temperature offset resistance and the releasability of each toner were tested as follows: As a fixability testing apparatus, a modified fixing apparatus (that is, a fixing apparatus of a color multifunction peripheral (TASKalfa 550ci (manufactured by Kyocera Document Solutions Inc.) provided with an external driving device and a fixing temperature controlling device) was used. As an evaluation apparatus, a color multifunction peripheral (TASKalfa 550ci (manufactured by Kyocera Document Solutions Inc.)) having been modified (by, specifically, removing a fixing apparatus) was used. As a recording medium, plain paper (C2 (manufactured by Fuji Xerox Co., Ltd.)) was used.

(Low-Temperature Fixability)

An unfixed solid image with a size of 2 cm×3 cm and a toner placement amount of 1.8 mg/cm$^2$ was formed by using the evaluation apparatus. The formed unfixed image was fixed on paper at a linear speed of 275 mm/sec. by using the fixability testing apparatus set to a prescribed temperature. The paper having the fixed image was folded in half with the image inside, and the fold portion was rubbed through 5 reciprocating motions by using a weight of 1 kg having a bottom covered with a cloth. Subsequently, the paper was unfolded, and the image was rubbed through 5 reciprocating motions by using the weight. If the toner was peeled off by 1 mm or less in the fold portion, the toner peeling property was evaluated as allowable, and if the toner was peeled off by more than 1 mm, the toner peeling property was evaluated as unallowable. The evaluation was performed with the fixing temperature increased from 90° C. in increments of 5° C., and the lowest fixing temperature at which the toner peeling property was evaluated as allowable was defined as a lowest fixable temperature. The low-temperature fixability was evaluated based on the following criteria. A toner evaluated as "good (G)" or "normal (N)" was determined to be allowable, and a toner evaluated as "poor (P)" was determined to be unallowable.

Good (G): The lowest fixable temperature was less than 100° C.

Normal (N): The lowest fixable temperature was 100° C. or more and less than 115° C.

Poor (P): The lowest fixable temperature was 115° C. or more.

(High-Temperature Offset Resistance)

An image (solid image) for evaluation was formed under the same conditions as in the evaluation of the low-temperature fixability except that the linear speed was 49 mm/sec., and this image (solid image) for evaluation was used for the evaluation of the high-temperature offset resistance.

The fixing temperature was increased from 110° C. in increments of 5° C., and the highest temperature at which an offset was not caused was defined as a high-temperature offset non-occurrence temperature. The high-temperature offset resistance was evaluated based on the following criteria. A toner evaluated as "good (G)" or "normal (N)" was determined to be allowable, and a toner evaluated as "poor (P)" was determined to be unallowable.

Good (G): The high-temperature offset non-occurrence temperature was 160° C. or more.

Normal (N): The high-temperature offset non-occurrence temperature was 145° C. or more and lower than 160° C.

Poor (P): The high-temperature offset non-occurrence temperature was lower than 145° C.

(Releasability (Releasable Toner Placement Amount))

An unfixed solid image was formed on a recording medium (with a leading edge margin of 3 mm) by using the evaluation apparatus. The resultant recording medium was allowed to pass through the fixability testing apparatus under conditions of a fixing temperature of 180° C. and a linear speed of 97 mm/sec. The toner placement amount was changed from 0.5 mg/cm$^2$ to 2.0 mg/cm$^2$ in increments of 0.1 mg/cm$^2$, and a toner placement amount (mg/cm$^2$) with which the recording medium was not adhered around a fixing roller was defined as a releasable toner placement amount. The releasability was evaluated based on the following criteria. A toner evaluated as "good (G)" or "normal (N)" was determined to be allowable, and a toner evaluated as "poor (P)" was determined to be unallowable.

Good (G): The releasable toner placement amount was 1.5 mg/cm$^2$ or more.

Normal (N): The releasable toner placement amount was 1.0 mg/cm$^2$ or more and less than 1.5 mg/cm$^2$.

Poor (P): The releasable toner placement amount was less than 1.0 mg/cm$^2$.

<Adhesion to Other Members>

A color multifunction peripheral (TASKalfa 550ci (manufactured by Kyocera Document Solutions Inc.)) was used for continuously outputting 10,000 copies of a vertical stripe pattern with a coverage rate of 20% printed on a recording medium under an environment of 32.5° C. and 80% RH. During the output, it was visually observed to check whether or not the image quality was degraded due to adhesion of the toner onto a developing sleeve or a photoconductive drum. The adhesion of the toner to these members was evaluated based on the following criteria. A toner evaluated as "not adhered" was determined to be allowable, and a toner evaluated as "adhered" was determined to be unallowable.

"Not adhered": No image change was visually observed.

"Adhered": Image change was visually observed.

<Image Fogging>

The same color multifunction peripheral as that used for the evaluation of the adhesion to other members was used for continuously outputting 5,000 copies of a character pattern with a coverage rate of 2% printed on a recording medium under an environment of 32.5° C. and 80% RH. Thereafter, 1,000 copies of a patch pattern with a coverage rate of 50% printed on a recording medium were output. Subsequently, a patch pattern for measuring a fogging density printed on a recording medium was output. The recording medium thus output for measuring a fogging density was used for measuring the maximum image density in a white background portion in the output patch pattern. A value obtained by subtracting an image density of blank paper obtained before outputting the patterns from the maximum image density in a white background portion in the patch pattern was defined as a fogging density. An image density was measured by using a reflection densitometer (RD-918 (manufactured by Gretag-Macbeth)). The image fogging was evaluated based on the following criteria. A toner evaluated as "good (G)" or "normal (N)" was determined to be allowable, and a toner evaluated as "poor (P)" was determined to be unallowable.

Good (G): The fogging density was less than 0.004.

Normal (N): The fogging density was 0.004 or more and less than 0.010.

Poor (P): The fogging density was 0.010 or more.

TABLE 5

| Example | 1 | 2 | 3 | 4 | 5 |
|---|---|---|---|---|---|
| Hardness measurement | | | | | |
| $H_{10}$[GPa] | 2.5 | 1.2 | 2.9 | 2.1 | 1.0 |
| $H_{100}$[GPa] | 0.7 | 0.6 | 0.9 | 0.5 | 0.4 |
| Evaluation 1 | | | | | |
| High-temperature preservability | | | | | |
| Degree of aggregation [%] | 1.0 | 1.5 | 0.5 | 0.8 | 1.8 |
| Evaluation | G | G | G | G | G |
| Evaluation 2 | | | | | |
| Low-temperature fixability | | | | | |
| Lowest fixable temperature [° C.] | 95 | 90 | 100 | 100 | 90 |
| Evaluation | G | G | N | N | G |
| High-temperature offset property | | | | | |
| Fixing temperature [° C.] | 200 | 180 | 200 | 200 | 160 |
| Evaluation | G | G | G | G | G |
| Releasability | | | | | |
| Releasable toner placement amount [mg/cm$^2$] | 1.8 | 1.5 | 1.8 | 1.8 | 1.5 |
| Evaluation | G | G | G | G | G |
| Adhesion to other members | not adhered | not adhered | not adhered | not adhered | not adhered |
| Image fogging | | | | | |
| Fogging density | 0.002 | 0.001 | 0.001 | 0.003 | 0.002 |
| Evaluation | G | G | G | G | G |

TABLE 6

| Comparative Example | 1 | 2 | 3 | 4 |
|---|---|---|---|---|
| Hardness measurement | | | | |
| $H_{10}$[GPa] | 2.0 | 0.5 | 0.8 | 3.2 |
| $H_{100}$[GPa] | 1.3 | 0.7 | 0.8 | 1.0 |
| Evaluation 1 | | | | |
| High-temperature preservability | | | | |
| Degree of aggregation [%] | 30.0 | 80.0 | 10.0 | 0.2 |
| Evaluation | P | P | N | G |
| Evaluation 2 | | | | |
| Low-temperature fixability | | | | |
| Lowest fixable temperature [° C.] | 100 | 90 | 90 | 130 |
| Evaluation | N | G | G | P |
| High-temperature offset property | | | | |
| Fixing temperature [° C.] | 160 | 120 | 145 | 140 |
| Evaluation | G | P | N | P |
| Releasability | | | | |
| Releasable toner placement amount [mg/cm$^2$] | 1.0 | 0.5 | 1.1 | 1.2 |
| Evaluation | N | P | N | N |
| Adhesion to other members | adhered | adhered | not adhered | not adhered |
| Image fogging | | | | |
| Fogging density | 0.012 | 0.020 | 0.008 | 0.005 |
| Evaluation | P | P | N | N |

In each of Examples 1 to 5, an electrostatic latent image developing toner containing toner particles that include at least a binder resin and a release agent and have hardness $H_{10}$ and $H_{100}$ measured by the nanoindentation method respectively falling in the prescribed ranges was obtained. It is understood from the evaluation results that such a toner is excellent in the storage stability and the low-temperature fixability, and can suppress occurrence of a high-temperature offset, quality degradation of a formed image due to adhesion of the toner to a developing sleeve or a photoconductive drum, and occurrence of fogging in a formed image.

In Comparative Example 1, a toner having too high hardness $H_{100}$ measured by the nanoindentation method was obtained. The following is understood from the evaluation results: If such a toner is used for forming an image, a toner image is difficult to satisfactorily fix on a recording medium at a low temperature, and furthermore, it is difficult to suppress the quality degradation of a formed image due to adhesion of the toner to a developing sleeve or a photoconductive drum and the occurrence of fogging in a formed image.

In each of Comparative Examples 2 and 3, a toner having too low hardness $H_{10}$ measured by the nanoindentation method was obtained. It is understood from the evaluation results that if such a toner is used for forming an image, the toner is difficult to show excellent storage stability. It is also understood that if the toner of Comparative Example 2 is used, it is difficult to suppress the occurrence of a high-temperature offset, the quality degradation of a formed image due to adhesion of the toner to a developing sleeve or a photoconductive drum and the occurrence of fogging in a formed image.

In Comparative Example 4, a toner having too high hardness $H_{10}$ measured by the nanoindentation method was obtained. It is understood from the evaluation results that if such a toner is used for forming an image, a toner image is difficult to satisfactorily fix on a recording medium at a low temperature, and it is difficult to suppress the occurrence of a high-temperature offset.

What is claimed is:

1. A method for producing an electrostatic latent image developing toner including a plurality of toner particles that each include a toner core containing a binder resin and a release agent, and a shell layer covering the toner core, the method comprising the steps of:

preparing the toner core; and forming the shell layer covering the toner core, wherein the step of preparing the toner core includes the sub-steps of:

supplying a first unprocessed liquid containing binder resin fine particles and release agent fine particles, or a first unprocessed liquid containing fine particles including the binder resin and the release agent;

supplying a second unprocessed liquid containing an aggregating agent;

mixing the first unprocessed liquid and the second unprocessed liquid; and obtaining the toner core containing the binder resin and the release agent by aggregating the binder resin fine particles and the release agent fine particles or aggregating the fine particles including the binder resin and the release agent, the method comprising the step of preparing the toner core by using a microreactor, wherein the microreactor includes a fixed disk A and a rotary disk B, a first unprocessed liquid supply section, and one or more second unprocessed liquid supply sections, the fixed disk A and the rotary disk B are circular disks, arranged to have a space between circular surfaces of the fixed disk A and the rotary disk B during the step of preparing the toner core, the first unprocessed liquid supply section supplies the first unprocessed liquid to the space from an end of the space, and each second unprocessed liquid supply section is formed to penetrate through an upper surface and a lower surface of the fixed disk on one side of a center of the circular surface of the fixed disk opposite to the first unprocessed liquid supply section, and supplies the second unprocessed liquid to the space from an upper surface side of the fixed disk.

2. A method for producing an electrostatic latent image developing toner according to claim 1, wherein each of the toner particles has surface hardness, measured by a nanoindentation method, satisfying the following conditions (1) and (2):

(1) the surface hardness of the toner particle attained with a displacement of 10 nm is 1 GPa or more and 3 GPa or less; and (2) the surface hardness of the toner particle attained with a displacement of 100 nm is 1 GPa or less.

* * * * *